United States Patent [19]

Sonoda et al.

[11] Patent Number: 5,018,494

[45] Date of Patent: May 28, 1991

[54] IDLING SPEED CONTROL DEVICE OF AN ENGINE

[75] Inventors: Yukihiro Sonoda; Kouichi Osawa; Hiroshi Kanai; Kouichi Hoshi; Hiroki Matsuoka, all of Susono; Michihiro Ohashi, Mishima; Hiroshi Sawada, Gotenba, all of Japan

[73] Assignee: Toyota Jidosha Kabushiki Kaisha, Toyota, Japan

[21] Appl. No.: 480,058

[22] Filed: Feb. 14, 1990

[30] Foreign Application Priority Data

Feb. 23, 1989 [JP] Japan ..... 1-41599

[51] Int. Cl.[5] ..... F02M 3/06; F02M 51/00

[52] U.S. Cl. ..... 123/339; 123/492; 123/493

[58] Field of Search ..... 123/339, 489, 493, 492

[56] References Cited

U.S. PATENT DOCUMENTS

| | | | |
|---|---|---|---|
| 4,364,348 | 12/1982 | Itoh et al. | 123/339 |
| 4,416,237 | 11/1983 | Aoki et al. | 123/493 |
| 4,422,497 | 12/1983 | Komoda et al. | 123/339 |
| 4,499,882 | 2/1985 | Saito et al. | 123/489 |
| 4,616,619 | 10/1986 | Saito et al. | 123/489 |
| 4,633,840 | 1/1987 | Saito et al. | 123/489 |
| 4,635,200 | 1/1987 | Egami et al. | 123/492 |

FOREIGN PATENT DOCUMENTS

| | | | |
|---|---|---|---|
| 59-173534 | 10/1984 | Japan . | |
| 0079839 | 4/1986 | Japan | 123/339 |
| 61-129435 | 6/1986 | Japan . | |
| 62-282139 | 12/1987 | Japan . | |
| 0227839 | 9/1989 | Japan | 123/339 |

*Primary Examiner*—Tony M. Argenbright
*Assistant Examiner*—Robert E. Mates
*Attorney, Agent, or Firm*—Kenyon & Kenyon

[57] ABSTRACT

An idling speed control device normally controlling the idling speed of the engine so that it becomes equal to a desired idling speed. At the time of acceleration, the lean time and the rich time of the air-fuel mixture are calculated during the lean-rich discriminating time, which is basically equal to a time of an occurrence of the lean time and the rich time when the air-fuel ratio is maintained at the stoichiometric air-fuel ratio at the time of acceleration. If the lean time becomes considerably longer than the rich time when the engine is started, the idling speed is increased.

30 Claims, 19 Drawing Sheets

PM
PM2
PM1
ΔPM
+39mmHg
0
-39mmHg
CLRN1
B1
A1
0
CLRN2
B2
A2
0
RICH
LEAN
CAC
C1
0
D1
KAC
KDC
C2
D2

CALCULATION OF DEPOSIT LEARNING COEFFICIENT
200
ΔPM ← PM−PM1
201
HAS FEEDBACK CONTROL BEEN CARRIED OUT?
NO
3
YES
203
CLRN1= 0 ?
YES
NO
204
CLRN2 = 0 ?
YES
NO
205
ΔPM≥39mmHg ?
NO
YES
207
CLRN1 ← 1
208
ΔPM≤−5mmHg ?
YES
3
NO
220
ΔPM≥5mmHg ?
YES
3
NO

CONTROL OF STEP MOTOR
500
IS FLAG STA SET ?
YES
NO
501
T > 70°C ?
YES
NO
502
IS START FLAG SET ?
YES
NO
503
CALCULATION OF DESIRED STEP POSITION PA
504
ST ← ST - 1
507
CALCULATION OF DESIRED STEP POSITION PB
508
IS WARM-UP FLAG SET ?
YES
NO
516
CALCULATION OF DESIRED ENGINE SPEED
517
CONTROL OF STEP MOTOR

IDLING SPEED CONTROL DEVICE OF AN ENGINE

BACKGROUND OF THE INVENTION

1. Field of the Invention

The present invention relates to an idling speed control device of an engine.

2. Description of the Related Art

In a fuel injection type engine, the basic amount of fuel injected by a fuel injector is usually calculated from the engine speed and the level of vacuum in the intake passage, or from the engine speed and the amount of air fed into the engine cylinder, and the actual amount of fuel injected by the fuel injector is feedback-controlled so that the air-fuel ratio of mixture fed into the engine cylinder becomes equal to a predetermined desired air-fuel ratio, for example, the stoichiometric air-fuel ratio, by correcting the basic amount of fuel on the basis of the output signal of the oxygen concentration detector (hereinafter referred to as an $O_2$ sensor) arranged in the exhaust passage of the engine. Nevertheless, even if such a feedback control is carried out, when the amount of fuel injected by the fuel injector is abruptly increased as at the time of acceleration, the amount of fuel adhering to the inner wall of the intake port in the form of a liquid fuel is increased. Since this liquid fuel is not fed into the engine cylinder immediately after adhering to the inner wall of the intake port, the air-fuel mixture fed into the engine cylinder temporarily becomes lean. Conversely, when the engine is decelerated, the absolute pressure in the intake port becomes low. As a result, since the amount of vaporization of the liquid fuel adhering to the inner wall of the intake port is increased, the air-fuel mixture fed into the engine cylinder temporarily becomes rich.

Consequently, in a fuel injection type engine, the amount of fuel injected by the fuel injector is usually increased at the time of an acceleration and decreased at the time of a deceleration, so that the air-fuel ratio of the mixture fed into the engine cylinder becomes equal to a desired air-fuel ratio, for example, the stoichiometric air-fuel ratio, even if the engine is operating in a transition state such as an acceleration state and a deceleration state. Consequently, in such a fuel injection type engine, the air-fuel ratio of mixture fed into the engine cylinder is controlled so that it becomes approximately equal to the desired air-fuel ratio, regardless of the operating state of the engine.

Nevertheless, in such a fuel injection type engine, blowby gas and lubricating oil, for example, pass through the clearance between the valve stem and the stem guide of the intake valve and flow into the intake port, and thus, when the engine is run for a long time, carbon particles, etc., contained in the blowby gas and the lubricating oil are gradually deposited on the inner wall of the intake port and the rear face of the valve head of the intake valve. These deposited carbon particles, i.e., the carbon deposit, have a physical characteristic of retaining liquid fuel, and thus, if the carbon deposit is deposited on the inner wall of the intake port etc., the amount of liquid fuel adhering to the inner wall of the intake port, etc., is increased, and this increases the time taken by the liquid fuel to flow into the engine cylinder, after the liquid fuel adheres to the inner wall of the intake port, etc. Consequently, although the air-fuel ratio of mixture fed into the engine cylinder can be controlled so that it becomes approximately equal to the stoichiometric air-fuel ratio, regardless of the engine operating state, while the engine is relatively new, if the deposit is deposited on the inner wall of the intake port, etc., after the engine has been run for a long time, since the time taken by the liquid fuel to flow into the engine cylinder is increased, as mentioned above, the air-fuel mixture fed into the engine cylinder becomes lean at the time of acceleration. In addition, since the amount of the liquid fuel adhering to the inner wall of the intake port etc. is increased, the air-fuel mixture fed into the engine cylinder becomes rich at the time of deceleration. At this time, since the amount of the deposit is increased, the air-fuel mixture becomes even leaner at the time of acceleration and even richer at the time of deceleration. In this case, for example, the leaner the air-fuel mixture at the time of acceleration, the longer the time for which the air-fuel mixture remains lean.

Consequently, in a known fuel injection type engine, the time during which the air-fuel mixture becomes lean (hereinafter referred to as a lean time) within a fixed time after the accelerating operation of the engine is started and the time during which the air-fuel mixture becomes rich (hereinafter referred to as a rich time) within the fixed time after the accelerating operation is started, are calculated, and the acceleration increase in the amount of fuel fed by the fuel injector is corrected on the basis of the lean time and the rich time, so that the air-fuel ratio of mixture fed into the engine cylinder becomes a desired air-fuel ratio even if the accelerating operation of the engine is carried out (see U.S. Pat. No. 4,499,882).

As mentioned above, when the carbon deposit adheres to the inner wall of the intake port, etc., the air-fuel mixture becomes lean at the time of acceleration. But if the deposit adheres to the inner wall of the intake port, etc., the air-fuel mixture also becomes lean when the engine is started. That is, at the time of starting the engine, when the injection of fuel is started, since a large amount of fuel thus injected is retained by the deposit on the inner wall of the intake port, etc., the air-fuel mixture becomes overlean when and immediately after the engine is started. As a result, it is difficult to start the engine, or even if the engine can be started, the idling operation of the engine will not be stable thereafter.

Therefore, in a known engine, to ensure an easy start of the engine, when the engine is started, the amount of fuel fed into the engine cylinder is increased as the amount of the deposit is increased (see Japanese Unexamined Patent Publication No. 61-129435).

Two methods of preventing the air-fuel mixture from becoming very lean due to the presence of the deposit when the engine is started, can be considered: (1) to increase the amount of fuel injected by the fuel injector, or (2) to increase the amount of air fed into the engine cylinder. When comparing these methods, however, the increase in the amount of air has a much greater influence on preventing the air-fuel mixture from becoming lean. Namely, even if the amount of fuel is increased when the engine is started, as described in the above-mentioned Japanese Unexamined Patent Publication No. 61-129435, since the fuel injected by the fuel injector is retained by the deposit, it is impossible to prevent the air-fuel mixture from becoming overrich immediately after the engine is started. Consequently, an increase in the amount of fuel at the time of starting of the engine will have no practical effect.

Conversely, when the engine is started, if the velocity of air flowing within the intake port is increased, since the vaporization of fuel injected by the fuel injector is promoted, the amount of fuel adhering to the deposit is reduced. Further, if the velocity of the air is increased, the vaporization of fuel adhering to the deposit is promoted, and the fuel adhering to the deposit is sucked by the air and fed into the engine cylinder at an earlier stage after the fuel has adhered to the deposit. As a result, it is possible to prevent the air-fuel mixture from becoming overlean. In this case, if the amount of fuel is increased, although the amount of fuel fed into the engine cylinder is increased, this increase in the amount of fuel fed into the engine cylinder is effected by increasing the amount of the fuel. Consequently, from a lean prevention point of view, the increase in the amount of fuel at the time of starting the engine has only a secondary effect

SUMMARY OF THE INVENTION

An object of the present invention is to provide an idling speed control device which enables an easy starting of the engine even if the deposit is adhered to the inner wall of the intake port, etc.

Therefore, according to the present invention, there is provided an idling speed control device of an engine having an intake passage and an exhaust passage, the device comprising: an oxygen concentration detector arranged in the exhaust passage and producing an output signal indicating whether an air-fuel mixture fed into the engine is lean or rich; feedback control means for controlling an amount of fuel fed into the engine in response to the output signal of the oxygen concentration detector, to bring an air-fuel ratio of the mixture to a desired air-fuel ratio; acceleration detecting means for detecting an accelerating operation of the engine; time calculating means for calculating a lean time and a rich time of the air-fuel mixture on the basis of the output signal of the oxygen concentration detector during a predetermined lean-rich discriminating time when the accelerating operation of the engine is carried out; difference calculating means for calculating a difference between the lean time and the rich time; start detecting means for detecting a starting operation of the engine; and idling speed control means for controlling an idling speed of the engine when the engine is started to increase the idling speed when the lean time is longer than the rich time and when the difference is larger than a predetermined value, and to reduce the idling speed when the rich time is longer than the lean time and when the difference is larger than a predetermined value The present invention may be more fully understood from the description of a preferred embodiment of the invention set forth below, together with the accompanying drawings.

DESCRIPTION OF A PREFERRED EMBODIMENT

Figure 1:
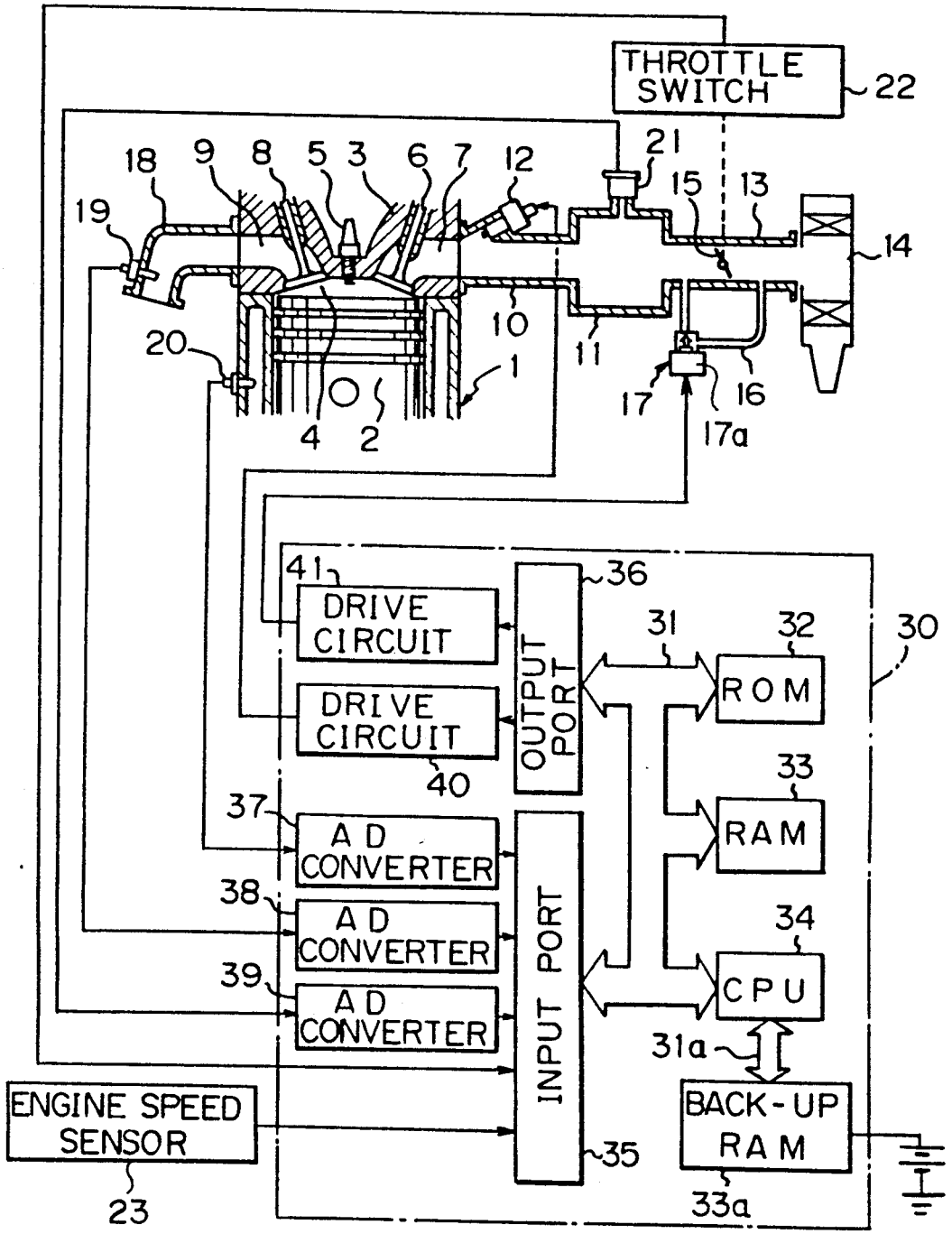
FIG. 1 is a schematically illustrated view of an engine.

Referring to FIG. 1, reference numeral 1 designates an engine body, 2 a piston, 3 a cylinder head, and 4 a combustion chamber formed between the piston 2 and the cylinder head 3; 5 designates a spark plug, 6 an intake valve, 7 an intake port, 8 an exhaust valve, and 9 an exhaust port. The intake port 7 is connected to a surge tank 11 via a corresponding branch pipe 10, and a fuel injector 12 is mounted on the branch pipe 10 to inject fuel into the corresponding intake port 7. The fuel injecting operation by the fuel injector 12 is controlled by a signal output of an electronic control unit 30. The surge tank 11 is connected to an air cleaner 14 via an intake duct 13, and a throttle valve 15 is arranged in the intake duct 13. A bypass passage 16 bypassing the throttle valve 15 is connected to the intake duct 13, and a bypass air control valve 17 driven by a step motor 17*a* is arranged in the bypass passage 16. The exhaust port 9 is connected to an exhaust manifold 18, and an $O_2$ sensor 19 is arranged in the exhaust manifold 18.

The electronic control unit 30 is constructed as a digital computer and comprises a ROM (read only memory) 32, a RAM (random access memory) 33, a CPU (microprocessor etc) 34, an input port 35, and an output port 36. The ROM 32, the RAM 33, the CPU 34, the input port 35 and the output port 36 are interconnected via a bidirectional bus 31. A back-up RAM 33*a* is connected to the CPU 34 via a bus 31*a*.

A coolant temperature sensor 20 producing an output voltage which is proportional to the cooling water temperature of the engine is mounted on the engine body 1, and the output voltage of the coolant temperature sensor 20 is input to the input port 35 via an AD converter 37. The output voltage of the $O_2$ sensor 19 is also input to the input port 35 via an AD converter 38. An absolute pressure sensor 21 producing an output voltage which is proportional to the absolute pressure in the surge tank 11 is arranged in the surge tank 11, and the output voltage of the absolute pressure sensor 21 is input to the input port 35 via an AD converter 39. A throttle switch 22 is attached to the throttle valve 15, to detect that the throttle valve 15 is completely closed, and the output signal of the throttle switch 22 is input to the input port 35. An engine speed sensor 23 produces an output pulse each time the crankshaft (not shown) is rotated by a predetermined crankangle, and the output pulse of the engine speed sensor 23 is input to the input port 35. The engine speed is calculated from this output pulse in the CPU 34. The output port 36 is connected to the fuel injector 12 and the step motor 17a of the bypass air control valve 17 via corresponding drive circuits 40 and 41. The bypass air control valve 17 is provided for controlling the idling speed of the engine, and the amount of the bypass air flowing within the bypass passage 16 is controlled by the bypass air control valve 17 so that the engine speed becomes equal to a desired idling speed at the time of idling after the completion of the warm-up of the engine.

The fuel injection time TAU of the fuel injector 12 is calculated from the following equation.

$$TAU=(TP+K\cdot TPAEW)\cdot FAF\cdot ASE\cdot F \quad (1)$$

where

TP: basic fuel injection time

TPAEW: correction fuel injection time for the transition state such as an accelerating state and a decelerating state K: correction coefficient of the correction fuel injection time TPAEW for the deposit FAF: feedback correction coefficient ASE: enrichment correction coefficient at the time of starting the engine F correction coefficient determined by the temperature of the engine cooling water and the temperature of air fed into the engine cylinder etc.

The basic fuel injection time TP is calculated from the engine speed NE and the absolute pressure PM in the surge tank 11. The relationship between the basic fuel injection time TP, the absolute pressure PM, and the engine speed NE is experimentally determined so that the air-fuel ratio of the fuel and air mixture fed into the engine cylinder becomes equal to a desired air-fuel ratio, for example, the stoichiometric air-fuel ratio, when fuel is injected from the fuel injector 12 for the basic fuel injection time TP in a cruising operating state of the engine, and this relationship is stored in the ROM 32. Consequently, when the cruising operation of the engine is carried out, if fuel is injected from the fuel injector 12 for the basic fuel injection time TP, which is calculated on the basis of the relationship, stored in the ROM 32, between the absolute pressure PM and the engine speed NE, the air-fuel ratio of the mixture fed into the engine cylinder becomes essentially approximately equal to the desired air-fuel ratio At this time, if the $O_2$ sensor 19 which can detect any air-fuel ratio is used, it is possible to freely use any air-fuel ratio as the desired air-fuel ratio. Nevertheless, the present invention will be hereinafter described with regard to the case wherein the desired air-fuel ratio is the stoichiometric air-fuel ratio, so that the present invention can be easily understood. In this case, if fuel is injected from the fuel injector 12 for the basic fuel injection time TP, the air-fuel ratio of mixture fed into the engine cylinder becomes essentially approximately equal to the stoichiometric air-fuel ratio.

When the engine operating state is not a transition state, i.e., when the cruising operation of the engine is carried out, the correction fuel injection time TPAEW becomes equal to zero and, in addition, ASE becomes equal to zero shortly after the engine is started. Consequently, at this time, the above-mentioned equation (1) can be represented as follows.

$$TAU=TP\cdot FAF\cdot F \quad (2)$$

Namely, at this time, the fuel injection time TAU is determined by the basic fuel injection time TP, the feedback correction coefficient FAF, and the correction coefficient F. In this case, the correction coefficient F is determined by the temperature of the engine cooling water and the temperature of air fed into the engine cylinder, etc. For example, this correction coefficient F becomes more than 1.0 before the completion of a warm-up period of the engine, wherein the cooling water temperature is low, and this correction coefficient F becomes equal to 1.0 or nearly 1.0 after the completion of a warm-up of the engine. In addition, the feedback correction coefficient FAF changes in response to the output signal of the $O_2$ sensor 19 so that the air-fuel ratio of mixture fed into the engine cylinder becomes equal to the stoichiometric air-fuel ratio.

Next, the feedback correction coefficient FAF will be described.

The $O_2$ sensor 19 produces an output voltage of about 0.1 volt when the air-fuel ratio of the mixture fed into the engine cylinder is higher than the stoichiometric air-fuel ratio, i.e., when the air-fuel mixture is lean, and the $O_2$ sensor 19 produces an output voltage of about 0.9 volt when the air-fuel ratio of the mixture is lower than the stoichiometric air-fuel ratio, i.e., when the air-fuel mixture is rich. Consequently, it can be determined, on the basis of the output signal of the $O_2$ sensor 19, whether the airfuel mixture is lean or rich.

Figure 2:
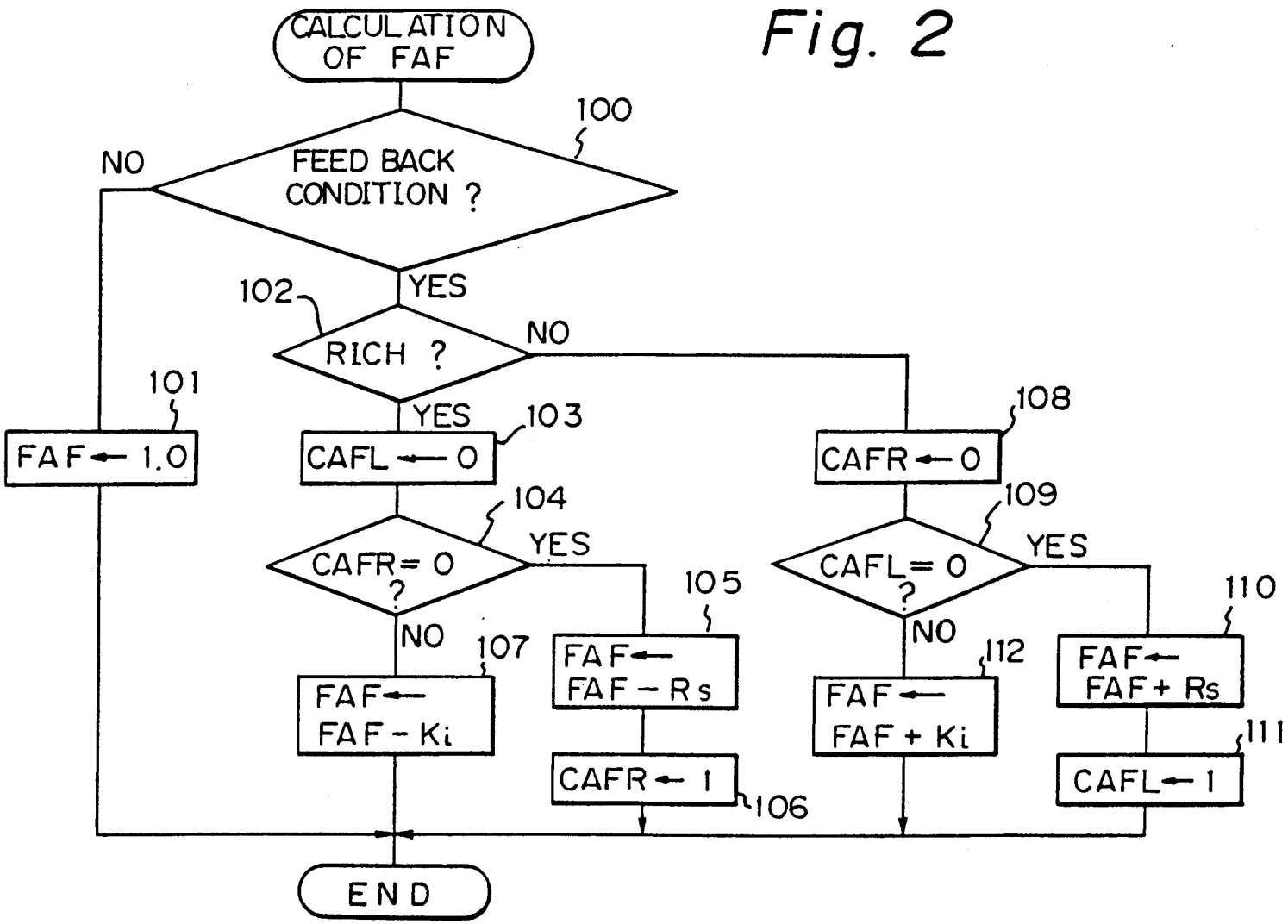
FIG. 2 is a flow chart for calculating the feedback correction coefficient FAF.

FIG. 2 illustrates a routine for calculating the feedback correction coefficient FAF on the basis of the signal output by the $O_2$ sensor 19.

Referring to FIG. 2, in step 100 it is determined whether or not the feedback control condition is satisfied. It is determined that the feedback control condition is satisfied when the operating state of the engine is not an engine starting state and when the temperature of the engine cooling water is higher than a predetermined temperature. When the feedback control condition is not satisfied, the routine goes to step 101 and the feedback control coefficient FAF becomes 1.0. Consequently, when the feedback control condition is not satisfied and when the cruising operation of the engine is carried out, the fuel injection time is calculated from the following equation.

$$TAU=TP\cdot F$$

When it is determined that the feedback control condition is satisfied, the routine goes to step 102 and it is determined, on the basis of the $O_2$ sensor 19, whether or not the air-fuel mixture fed into the engine cylinder is rich. If the air-fuel mixture was lean in the preceding processing cycle, and if the air-fuel mixture becomes rich in the present processing cycle, the routine goes to step 103 and the flag CAFL is reset. Then, in step 104 it is determined whether or not the flag CAFR, which is reset when the air-fuel mixture changes from rich to lean, has been reset. When the air-fuel mixture changes from lean to rich, since the flag CAFR has been reset, the routine goes to step 105 and a predetermined skip value Rs is subtracted from the feedback control coefficient FAF. Then, in step 106 the flag CAFR is set. Consequently, in the next processing cycle, the routine goes from step 104 to step 107 and a predetermined fixed value Ki($Ki << Rs$) is subtracted from the feedback correction coefficient FAF.

Figure 3:
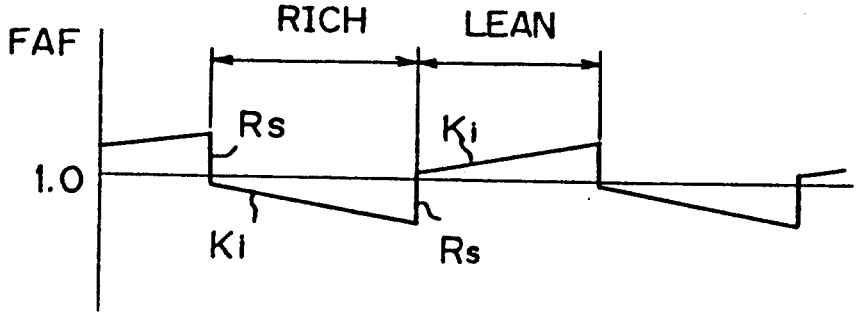
FIG. 3 is a diagram illustrating a change in the feedback correction coefficient FAF.

When the air-fuel mixture changes from rich to lean, the routine goes to step 108 and the flag CAFR is reset. Then, in step 109 it is determined whether or not the flag CAFL has been reset. At this time, since the flag CAFL has been reset, the routine goes to step 110, and the predetermined skip value Rs is added to the feedback control coefficient FAF. Then, in step 111, the flag CAFL is set. Consequently, in the next processing cycle, the routine goes from step 109 to step 112 and the predetermined fixed value Ki is added to the feedback correction coefficient FAF. Consequently, the feedback correction coefficient FAF changes as illustrated in FIG. 3. When the air-fuel mixture becomes rich, since the feedback control coefficient FAF becomes small, the fuel injection time TAU becomes short. Conversely, when the air-fuel mixture becomes lean, since the feedback control coefficient FAF becomes large, the fuel injection time TAU becomes long. Thus, the air-fuel ratio of the mixture is controlled so that it becomes equal to the stoichiometric air-fuel ratio.

As mentioned above, when the cruising operation of the engine is carried out, and when the feedback control of the air-fuel ratio is carried out, the air-fuel ratio of the mixture fed into the engine cylinder is controlled so that it becomes equal to the stoichiometric air-fuel ratio. Where the fuel injection time TAU is calculated by using the above-mentioned equation (2), however, when the operating state of the engine is a transition state, such as an acceleration state and a deceleration state, the air-fuel ratio of the mixture deviates from the stoichiometric air-fuel ratio even if the feedback control is carried out and even if a deposit is not adhered to the inner wall of the intake port, etc. Namely, when the engine is accelerated, the air-fuel mixture temporarily becomes lean, and when the engine is decelerated, the air-fuel mixture temporarily becomes rich. Such a deviation of the air-fuel ratio occurring at the time of a transition state of the engine is based, on one hand, on the time lag until the fuel injecting operation is actually carried out after the calculation of the fuel injection time TAU is started, and on the other hand, on the time lag until the liquid fuel adhering to the inner wall of the intake port, etc., flows into the engine cylinder. These time lags, generated at the time of acceleration, will now be described with reference to FIGS. 4 and 5.

Figure 4:
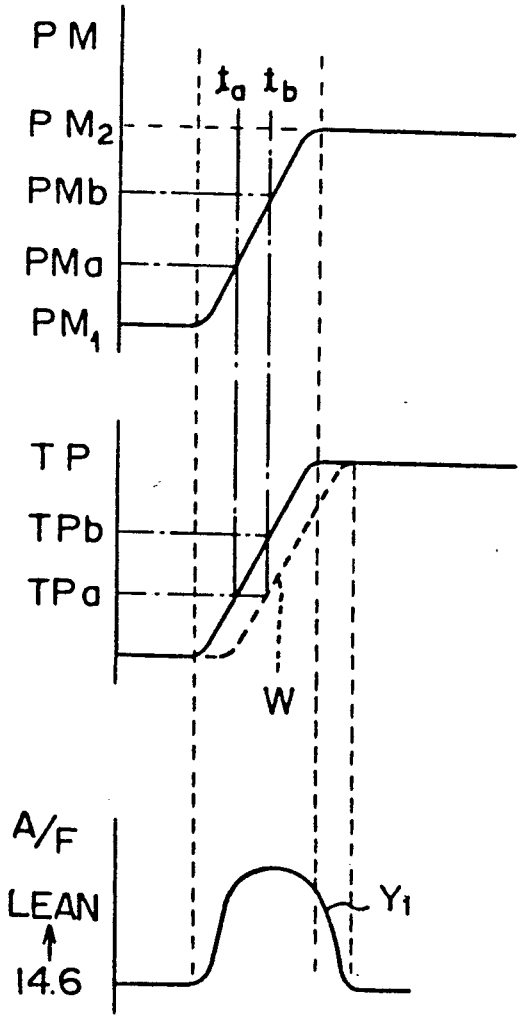
FIG. 4 is a diagram illustrating the deviation of the air-fuel ratio, caused by the delay time of the actual injection.

FIG. 4 illustrates the deviation of the air-fuel ratio based on the time lag until the fuel injecting operation is actually carried out after the calculation of the fuel injection time TAU is started. As illustrated in FIG. 4, if the engine is accelerated, and thus the absolute pressure PM in the surge tank 11 is increased from PM1 to PM2, the basic fuel injection time TP calculated from the absolute pressure PM and the engine speed NE is increased accordingly. Assuming that the calculation of the fuel injection time TAU is started at a time ta, since the absolute pressure PM is equal to PMa at this time, the basic fuel injection time TP is calculated based on PMa, and this calculated basic fuel injection time TP is defined as TPa.

The calculation of the fuel injection time TAU is usually started at a predetermined crank angle, and after the crankshaft has rotated through a predetermined angle, the actual fuel injecting operation is started. Namely, in FIG. 4, if the calculation of the fuel injection time TAU is started at a time ta, the actual fuel injection is started at a time tb. At the time tb, however, the absolute pressure PM is increased to PMb, which is higher than PMa, and thus the basic fuel injection time TPb, which is necessary for equalizing the air-fuel ratio of the mixture with the stoichiometric air-fuel ratio at the time tb, becomes longer than the basic fuel injection time TPa. Nevertheless, in the time tb, since fuel is injected by only the time calculated based on the basic fuel injection time TPa, the amount of fuel actually injected by the fuel injector 12 becomes smaller than the amount of fuel necessary for equalizing the air-fuel ratio of mixture with the stoichiometric air-fuel ratio, and thus the air-fuel mixture becomes lean. Namely, in practice, since the basic fuel injection time TP changes along the broken line W in FIG. 4, the air-fuel mixture becomes lean as illustrated by $Y_1$ during the time illustrated by the broken line W.

Figure 5:
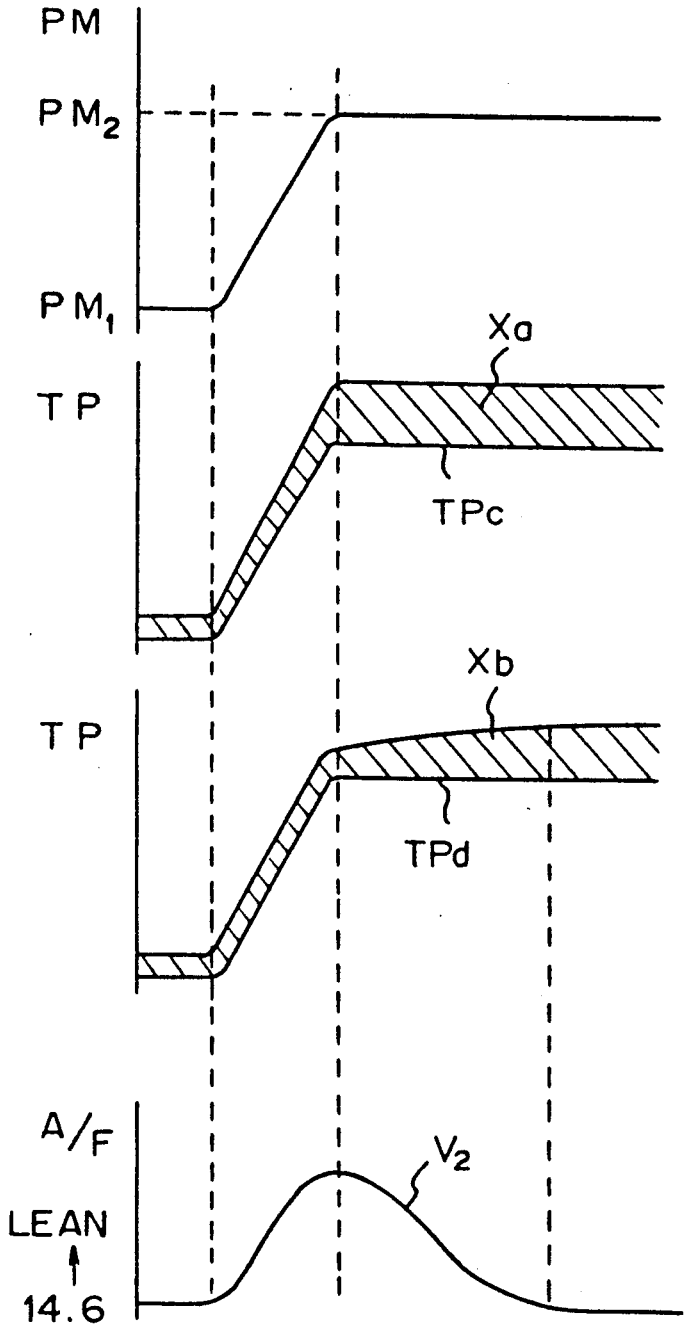
FIG. 5 is a diagram illustrating the deviation of the air-fuel ratio, caused by the delay time of the actual inflow of liquid fuel into the engine cylinder.

FIG. 5 illustrates the deviation of the air-fuel ratio based on the time lag until the liquid fuel adhering to the inner wall of the intake port, etc. flows into the engine cylinder. FIG. 5 also illustrates the case wherein the absolute pressure PM is increased from PM1 to PM2. In FIG. 5, the curved lines TPc and TPd indicate a change in the basic fuel injection time TP, and the hatching Xa and Xb indicates the amount of liquid fuel flowing into the engine cylinder, which depends on the amount of fuel injected by the fuel injector 12, i.e., on the amount of liquid fuel adhering to the inner wall of the intake port, etc., and the amount of liquid fuel flowing into the engine cylinder is increased as the amount of fuel injected by the fuel injector 12 is increased, when the cruising operation of the engine is carried out, the amount of liquid fuel flowing into the engine cylinder is maintained at an approximately constant value, and at this time, the amount of liquid fuel flowing into the engine cylinder is increased as the engine load becomes higher. The hatching Xa illustrates the case wherein it is assumed that the amount of fuel flowing into the engine cylinder at each absolute pressure PM is the same as that when the cruising operation of the engine is carried out. In this case, also at the time of acceleration, the air-fuel ratio of mixture fed into the engine cylinder is maintained at the stoichiometric air-fuel ratio. In practice, however, when the accelerating operation of the engine is carried out, even if the amount of liquid fuel adhering to the inner wall of the intake port, etc. is increased, since all of the liquid fuel does not immediately flow into the engine cylinder, the amount of liquid fuel flowing to the engine cylinder at the time of acceleration becomes smaller than that illustrated by the hatching Xa. As the amount of liquid fuel adhering to the inner wall of the intake port, etc. is increased, the amount of liquid fuel flowing into the engine cylinder is gradually increased, and after the completion of the accelerating operation of the engine, the amount of liquid fuel flowing into the engine cylinder becomes equal to that during the cruising operation of the engine. The hatching Xb indicates the amount of liquid fuel which actually flows into the engine cylinder. Consequently, as can be seen from FIG. 5, the amount of liquid fuel Xb flowing into the engine cylinder becomes smaller than that of the amount of liquid fuel Xa flowing during the cruising operation of the engine until some time has elapsed after the completion of the accelerating operation of the engine, and consequently, during this time, the air-fuel mixture becomes lean as illustrated by $Y_2$.

Figure 6:
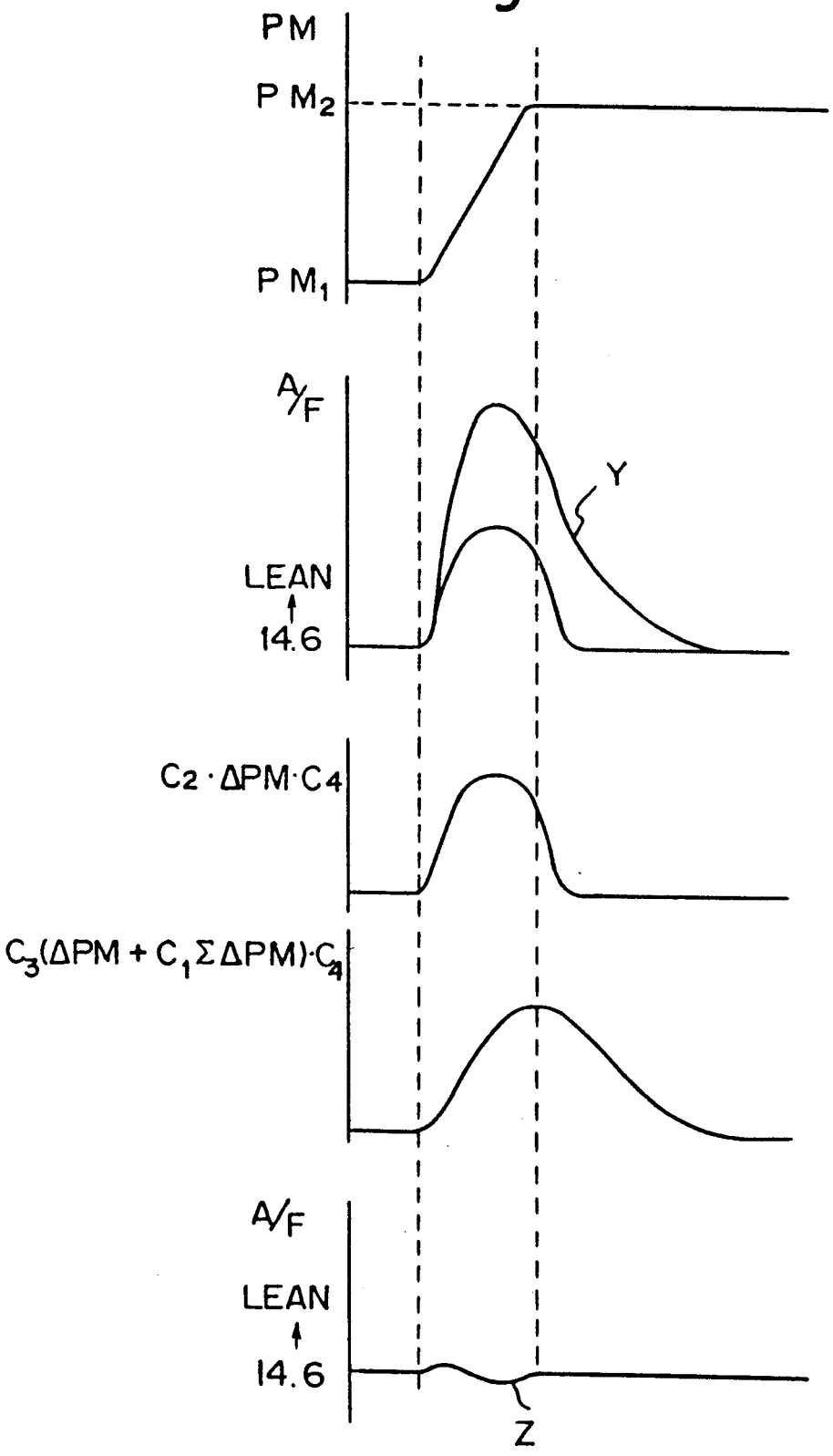
FIG. 6 is a diagram illustrating the amount of fuel to be increased or decreased at the time of acceleration.

Therefore, at the time of acceleration, as illustrated by Y in FIG. 6, the shape of the lean curve is formed by superposing the lean curve $Y_1$ on the lean curve $Y_2$. Accordingly, as illustrated in FIG. 6, if the amount of fuel injected by the fuel injector 12 is increased by an amount $C_2 \cdot \Delta PM \cdot C_4$ which corresponds to the lean curve $Y_1$, and at the same time, if the amount of fuel injected by the fuel injector 12 is increased by an amount $C_3 \cdot (\Delta PM + C_1 \ \Delta PM) \cdot C_4$ which corresponds to the lean curve $Y_2$, the air-fuel mixture is maintained at approximately the stoichiometric air-fuel ratio as illustrated by Z. In the above-mentioned amounts corresponding to the lean curves $Y_1$ and $Y_2$, $\Delta PM$ indicates a rate of change of the absolute pressure PM, and $C_4$ indicates a coefficient for converting the absolute pressure PM to time.

Namely, in FIG. 4, the shortage (TPb−TPa) of the basic fuel injection time TP is approximately equal to a value obtained by multiplying the time $(t_b - t_a)$ by $\Delta PM \cdot C_4$ which is at $t_a$, and if the time $(t_b - t_a)$ is represented by $C_2$, the shortage of the basic fuel injection time TP can be represented as $C_2 \cdot \Delta PM \cdot C_4$. In this case, since the time $(t_b - t_a)$ corresponds to the rotation angle of the crankshaft, $C_2$ is a function of the engine speed NE.

The curved line corresponding to the line curve $Y_2$ can be represented by $C_3 \cdot (\Delta P + C_1 \Sigma \Delta PM) \cdot C_4$. Note, $C_1$ denotes an attenuation coefficient and is smaller than 1.0. This $C_3 \cdot (\Delta P + C_1 \Sigma \Delta PM) \cdot C_4$ is calculated when calculating the fuel injection time TAU. The value of $C_3 \cdot (\Delta P + C_1 \Sigma \Delta PM) \cdot C_4$ is rapidly increased when $\Delta PM$ is large, and the value of $C_3 \cdot (\Delta P + C_1 \Sigma \Delta PM) \cdot C_4$ is gradually reduced when $\Delta PM$ becomes small. When the engine temperature or the temperature of air fed into the engine cylinder becomes low, the amount of liquid fuel adhering to the inner wall of the intake port, etc. is increased, and accordingly, the air-fuel mixture becomes leaner. Consequently, $C_3$ is a function of both the engine temperature and the temperature of air fed into the engine cylinder.

Therefore, if the amount of fuel injected by the fuel injector 12 is increased by an amount equal to the sum of $C_2 \cdot \Delta PM \cdot C_4$ and $C_3 \cdot (\Delta PM + C_1 \rho \Delta PM) \cdot C_4$ at the time of acceleration, the air-fuel mixture can be maintained at the stoichiometric air-fuel ratio. This amount of fuel to be increased at the time of acceleration represents the correction fuel injection time TPAEW in the above-mentioned equation (1), and thus TPAEW is represented as follows.

$$TPAEW = \{C_2 \cdot \Delta PM + C_3 \cdot (\Delta PM + C_1 \Sigma \Delta M)\} \cdot C_4 \quad (3$$

In addition, where the fuel injection time TAU is calculated based on the above-mentioned equation (2), at the time of deceleration, the air-fuel mixture becomes rich and changes along the rich curves which are similar to the lean curves $Y_1$and $Y_2$ illustrated in FIGS. 4 and 5. Consequently, at this time, if using TPAEW shown in the above-mentioned equation (3) during the calculation of the fuel injection time TAU, the air-fuel mixture fed into the engine cylinder is maintained at the stoichiometric air-fuel ratio. At this time, however, since $\Delta PM$ becomes negative, TPAEW also becomes negative.

Consequently, where carbon is not deposited on the inner wall of the intake port, etc., if the fuel injection time TAU is calculated by the following equation, it is possible to maintain the air-fuel mixture at the stoichiometric air-fuel ratio, regardless of the operating state of the engine.

$$TAU = (TP + TPAEW) \cdot FAF \cdot F \quad (4)$$

Nevertheless, when the engine has been used for a long time, and thus a carbon deposit is adhered to the inner wall of the intake port, etc., since this deposit has a physical nature of retaining liquid fuel, the amount of liquid fuel adhering to the inner wall of the intake port, etc., is increased, and thus the time required for the liquid fuel to flow into the engine cylinder is prolonged. Consequently, where the deposit is adhered to the inner wall of the intake port, etc., if the above-mentioned equation (4) is used to calculate the fuel injection time TAU, the air-fuel mixture will deviate from the stoichiometric air-fuel ratio. Namely, at the time of acceleration, since the inflow of liquid fuel to the engine cylinder is delayed due to the presence of the deposit, the air-fuel mixture becomes lean, and at the time of deceleration, since the amount of liquid fuel adhering to the inner wall of the intake port, etc., is increased due to the presence of the deposit, the air-fuel mixture becomes rich Therefore, to maintain the air-fuel ratio of mixture at the stoichiometric air-fuel ratio even if the deposit is adhered to the inner wall of the intake port, etc., the correction fuel injection time TPAEW is multiplied by the correction coefficient K, and an increase or a decrease in the amount of fuel injected by the fuel injector 12 at the time of acceleration or deceleration, respectively, is corrected by the correction coefficient K. In this case, as indicated by the above-mentioned equation (1), the fuel injection time TAU is calculated from the following equation.

$$TAU = (TP + K \cdot TPAEW) \cdot FAF \cdot F$$

Figure 7A:
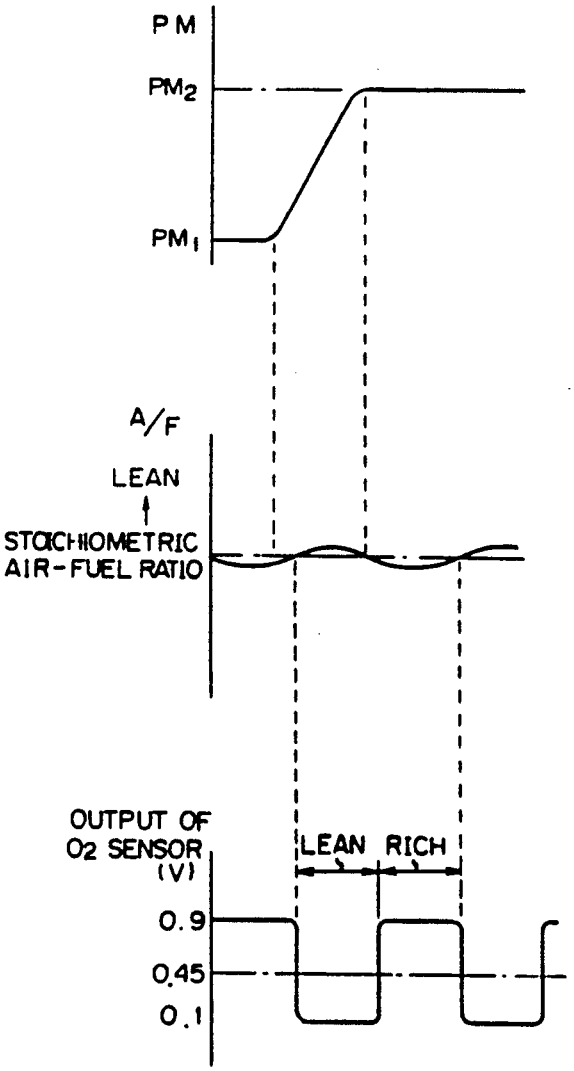
FIGS. 7(*a–h*) is a diagram illustrating the lean state and the rich state of the air-fuel mixture.
Figure 7B:
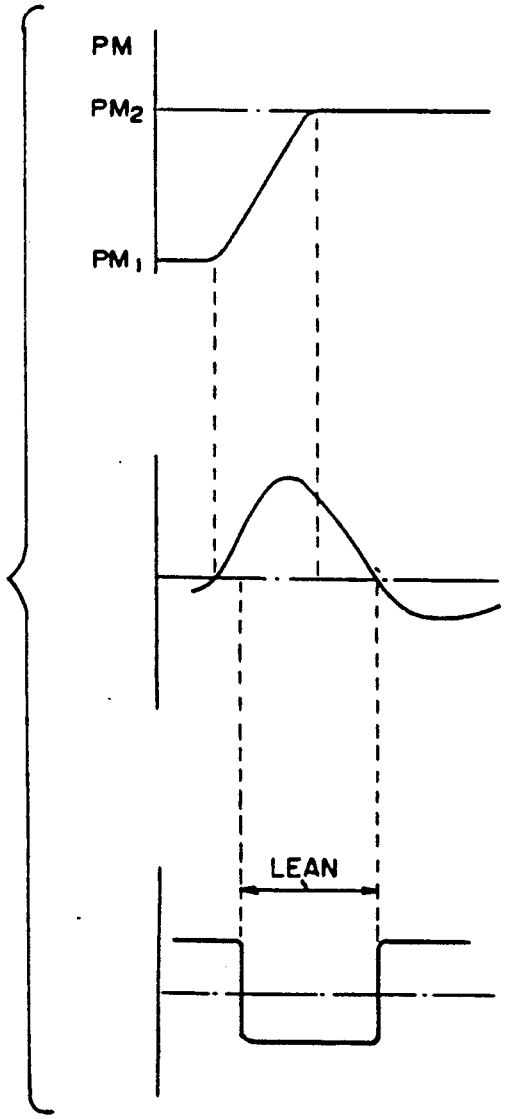

Namely, when a deposit is not adhered to the inner wall of the intake port, etc., and thus the air-fuel ratio of mixture is maintained at the stoichiometric air-fuel ratio even when the accelerating operation of the engine is carried out, as illustrated in FIG. 7(A), the lean state and the rich state of the air-fuel mixture is alternately repeated at almost the same time frequency, after the accelerating operation of the engine is started. Consequently, at this time, the lean time and the rich time become almost the same. Conversely, if the deposit is adhered to the inner wall of the intake port, etc., as illustrated in FIG. 7(B), the air-fuel mixture temporarily becomes lean at the time of acceleration. As a result, as illustrated by FIG. 7(B), the lean time after the start of acceleration becomes longer than the rich time. Conversely, if the air-fuel mixture temporarily becomes rich at the time of deceleration, the rich time after the start of acceleration becomes longer than the lean time. Therefore, by comparing the lean time with the rich time, it is possible to determine whether or not the air-fuel mixture is temporarily lean or rich.

Therefore, generally, if the lean time becomes longer than the rich time, and the difference between the lean time and the rich time exceeds a fixed time at the time of acceleration, the correction coefficient K is increased, and thus an acceleration increasing ratio of the amount of fuel is increased. Conversely, if the rich time becomes longer than the lean time, and the difference between the rich time and the lean time exceeds a fixed time at the time of acceleration, the correction coefficient K is decreased, and thus the acceleration increasing ratio of the amount of fuel is decreased.

On the other hand, if the rich time becomes longer than the lean time, and the difference between the rich time and the lean time exceeds a fixed time at the time of deceleration, the correction coefficient K is increased, and thus a deceleration reducing rate of the amount of fuel is increased. Conversely, if the lean time becomes longer than the rich time, and the difference between the lean time and the rich time exceeds a fixed time, the correction coefficient K is decreased, and thus the deceleration reducing rate of the amount of fuel is decreased.

Next, the routine for calculating the correction coefficient K, i.e., the deposit learning coefficient K, will be described on the basis of the flow chart illustrated in FIGS. 9 and 10 with reference to the time chart illustrated in FIG. 8. This routine is processed by sequential interruptions which are executed at every crankangle of 360°.

Figures 9, 9A, 9B:
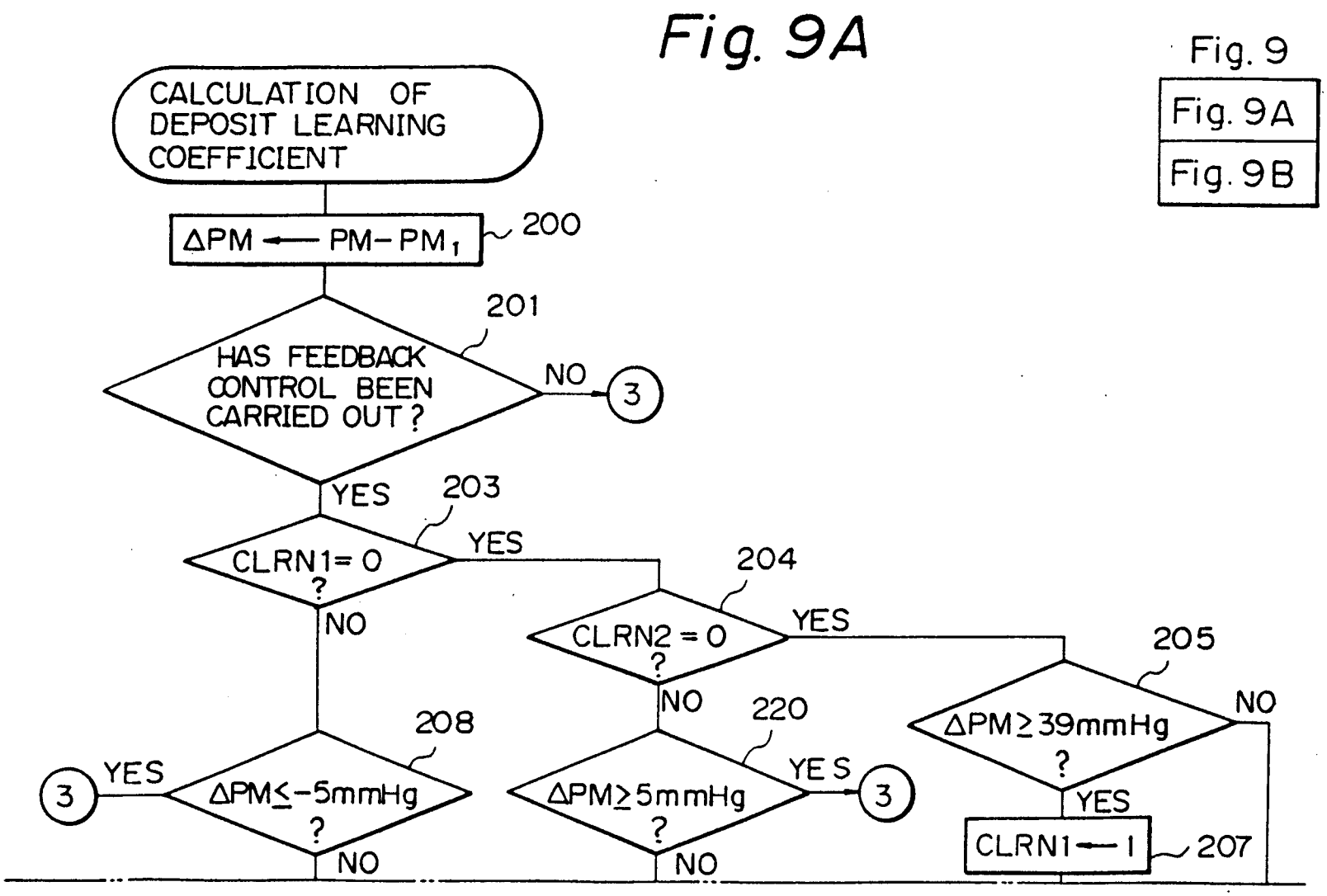
FIGS. 9, 9*a*, 9*b* and 10 are flow charts for calculating the deposit learning coefficient.
Figure 9B:
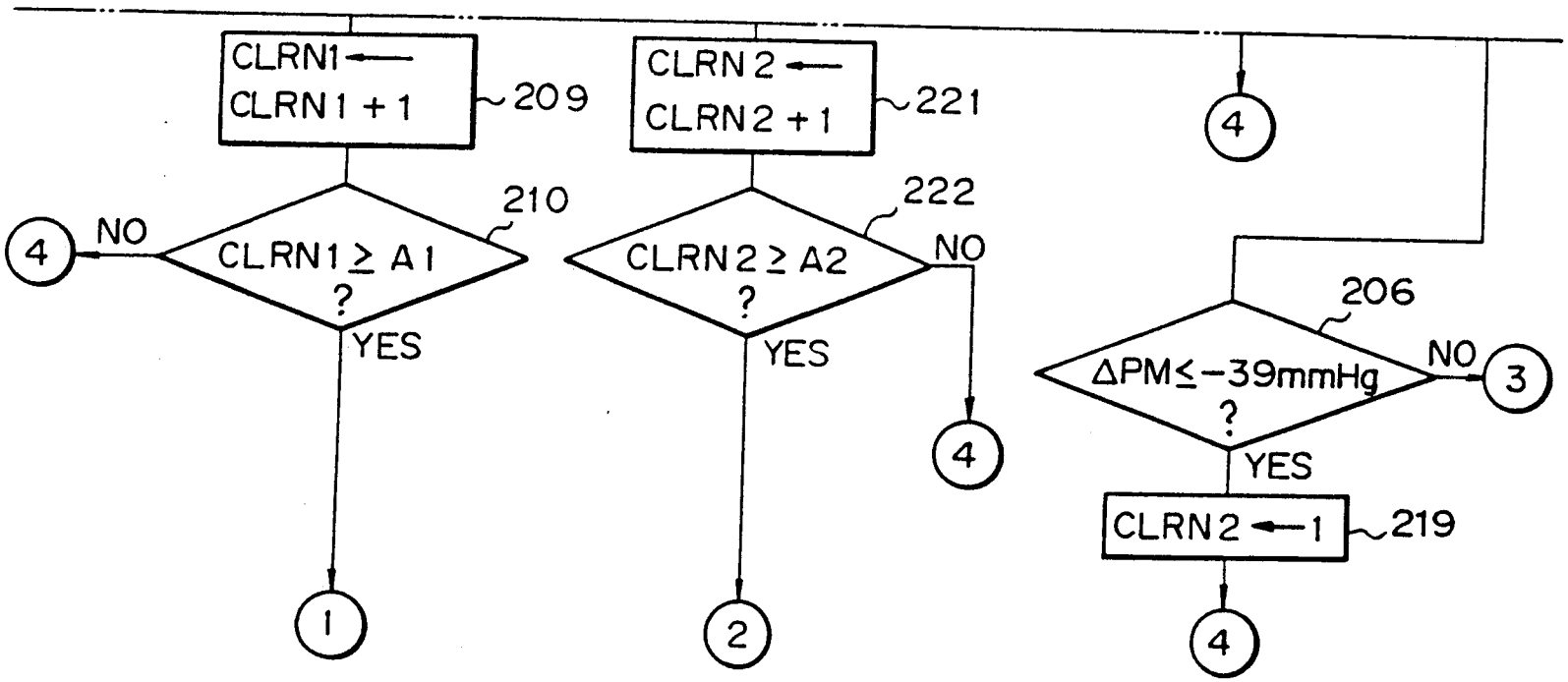
Figure 10:
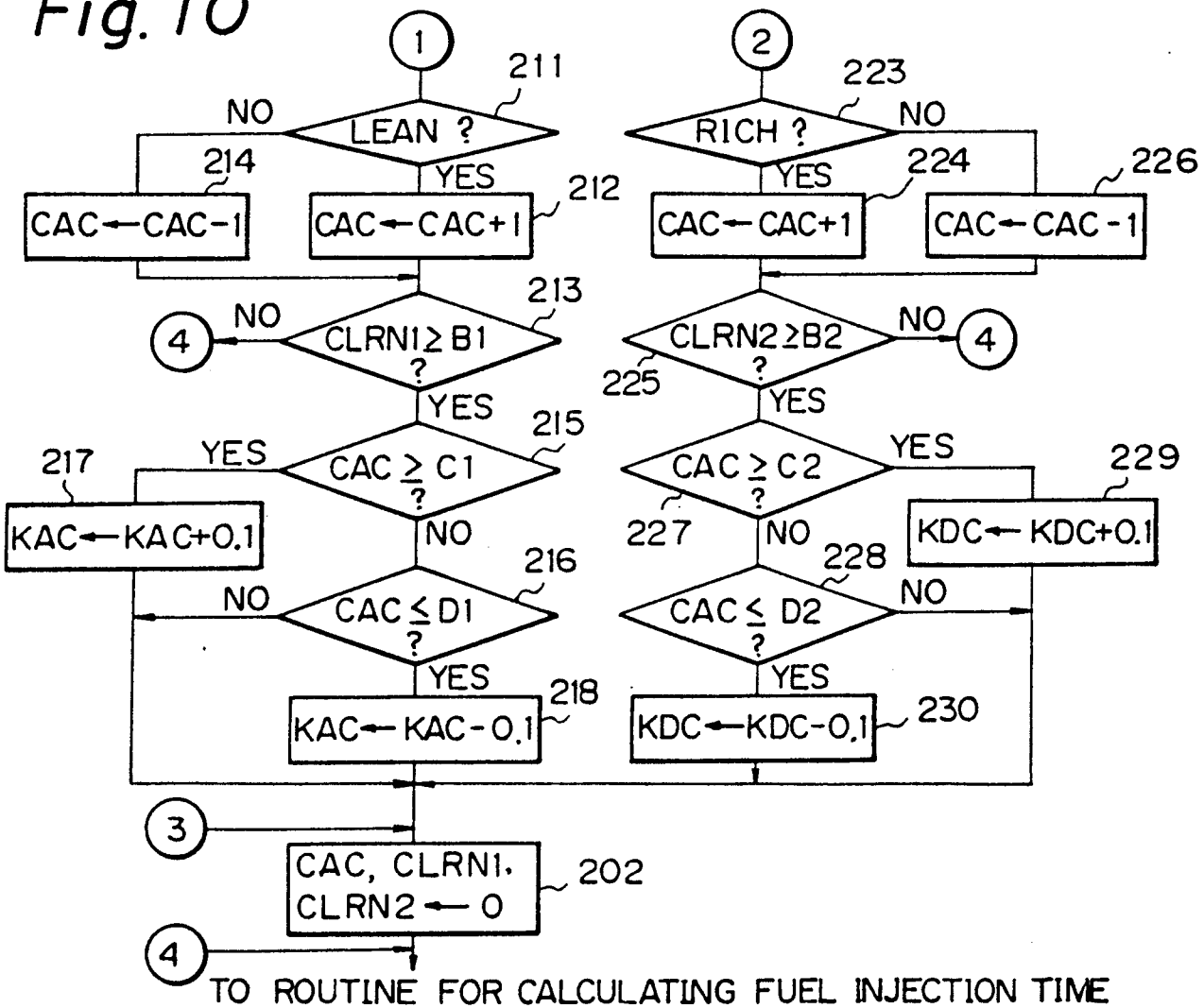

Referring to FIGS. 9 and 10, in step 200 the absolute pressure $PM_1$ in the surge tank 11, which is detected by the absolute pressure sensor 21 in the preceding processing cycle, is subtracted from the present absolute pressure PM in the surge tank 11, and the result of the subtraction ΔPM is memorized as a changing rate of the absolute pressure ΔPM. Then, in step 201 it is determined, on the basis of the $O_2$ sensor 19, whether or not the feedback control has been carried out. If the feedback control has not been carried out, the routine goes to step 202 and counters CAC, CLRN 1 and CLRN 2 are cleared. When the feedback control is started, the routine goes to step 203 and it is determined whether or not the counter CLRN 1 is cleared. At this time, since the counter CLRN 1 is cleared, the routine goes to step 204 and it is determined whether or not the counter CLRN 2 is cleared. At this time, since the counter CLRN 2 is cleared, the routine goes to step 205. In step 205 it is determined whether or not ΔPM is larger than a fixed value, for example, 39 mmHg, i.e., an accelerating operation of the engine has been carried out. If ΔPM $<39$ mmHg, it is determined that an accelerating operation of the engine has not been carried out, and the routine goes to step 206. In step 206 it is determined whether or not ΔPM is smaller than a fixed value, for example $-39$ mmHg, i.e., whether the decelerating operation of the engine has been carried out. If ΔPM $<-39$ mmHg, it is determined that the decelerating operation of the engine has not been carried out and the routine goes to step 202. In step 202, the counters CAC, CLRN 1 and CLRN 2 are cleared.

When it is determined in step 205 that ΔPM is larger than 39 mmHg, i.e., the accelerating operation of the engine has been carried out, the routine goes to step 207 and 1 is set in the counter CLRN 1. Then, the routine goes to a routine for calculating the fuel injection time. In the next processing cycle, the routine goes from step 203 to step 208, and it is determined whether or not ΔPM has become smaller than $-5$ mmHg, i.e., the engine is decelerated after the accelerating operation of the engine has been started. If ΔPM $\geq -5$ mmHg, the routine goes to step 202 and the counters CAC, CLRN 1 and CLRN 2 are cleared.

Conversely, when the accelerating operation of the engine is continuously carried out, since ΔPM becomes larger than $-5$ mmHg, the routine goes from step 208 to step 209 and the counter CLRN 1 is incremented by one. That is, as illustrated in FIG. 8(A), when the accelerating operation of the engine is started and the absolute pressure PM increases from $PM_1$ to $PM_2$, if ΔPM exceeds 39 mmHg, the count up operation of the counter CLRN 1 is started.

Then, in step 210 it is determined whether or not the count value of the counter CLRN 1 exceeds a predetermined fixed value A1. If CLRN 1 $<$ A1, the routine goes to the routine for calculating the fuel injection time. When CLRN 1 exceeds A1, the routine goes to step 211 and it is determined from the output signal of the $O_2$ sensor 19 whether or not the air-fuel mixture fed into the engine cylinder is lean. When the air-fuel mixture is lean, the routine goes to step 212 and the counter CAC is incremented by one. Then the routine goes to step 213. When the air-fuel mixture is not lean, i.e., is rich, the routine goes to step 214 and the counter CAC is decremented by one. Then the routine goes to step 213. In step 213, it is determined whether or not the count value of the counter CLRN 1 exceeds a predetermined fixed value B1. If CLRN 1 $<$ B1, the routine goes to the routine for calculating the fuel injection time. That is, as illustrated in FIG. 8(A), it is determined whether the air-fuel mixture is lean or rich during the time in which the count value of the counter CLRN 1 increases from A1 to B1. During this time, when the air-fuel mixture becomes lean the counter CAC is counted up, and when the air-fuel mixture becomes rich the counter CAC is counted down. Thus, during the time in which the count value of the counter CLRN 1 increases from A1 to B1, if the lean time becomes longer than the rich time the count value of the counter CAC is increased, and if the rich time becomes longer than the lean time the count value of the counter CAC is reduced. Consequently, from the count value of the counter CAC at the moment when the count valve of the counter CLRN 1 reaches B1, it is possible to determine whether the air-fuel mixture has become lean or rich at the time of acceleration As mentioned above, in the embodiment illustrated in FIG. 8, during the time in which the count value of the counter CLRN 1 increases from A1 to B1, it is determined whether or not the air-fuel mixture has become lean or rich, and accordingly, the time in which the count value of the counter CLRN 1 increases from A1 to B1 becomes a lean-rich discriminating time.

Next, this lean-rich discriminating time will be described with reference to FIGS. 7(C), (D), (E), (F), (G) and (H). In these Figures, the lean-rich discriminating time is indicated by L, L′ or L″.

Figure 7C:
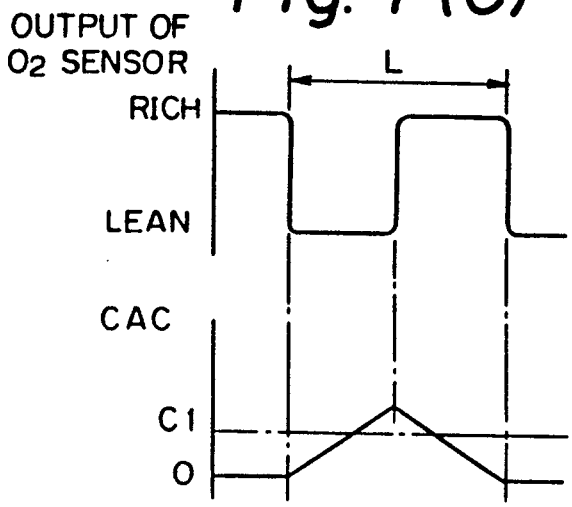
Figure 7D:
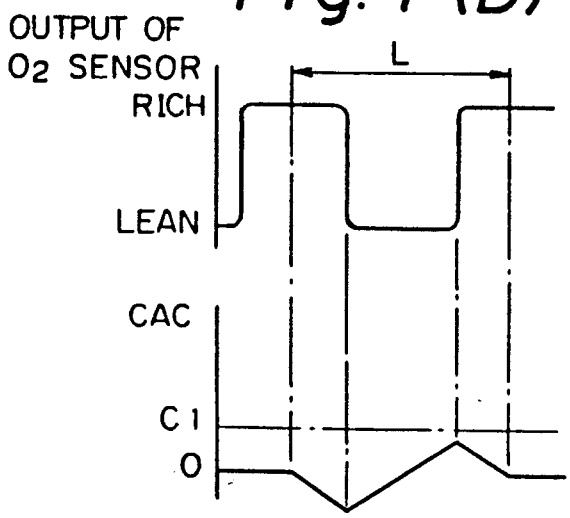

FIGS. 7(C), (D) and (E) illustrate changes in the output voltage of the $O_2$ sensor 19 and in the count value of the counter CAC when the engine is accelerated, when a deposit is not adhered to the inner wall of the intake port, etc. In this case, as illustrated in FIGS. 7(C), (D) and (E), the lean state and the rich state are alternately repeated at almost the same time frequency, even if the accelerating operation of the engine is carried out. In the embodiment illustrated in FIG. 8, as illustrated in FIG. 7(C), the lean-rich discriminating time L is determined so that it becomes equal to a time in which the lean state or the rich state occurs when the accelerating operation of the engine is carried out. Namely, the predetermined values A1 and B1 for the counter CLRN 1 are determined so that the time in which the counter value of the counter CLRN 1 increases from A1 to B1 becomes equal to a time in which the lean state or the rich state occurs at the time of acceleration. If the lean-rich discriminating time L is determined as mentioned above, when a deposit is adhered to the inner wall of the intake port, etc., the lean time and the rich time in the lean-rich discriminating time L become almost the same, as illustrated in FIGS.

7(C) and (D). Consequently, when the lean-rich discriminating time L ends, the count value of the counter CAC becomes equal to zero.

Figure 7E:
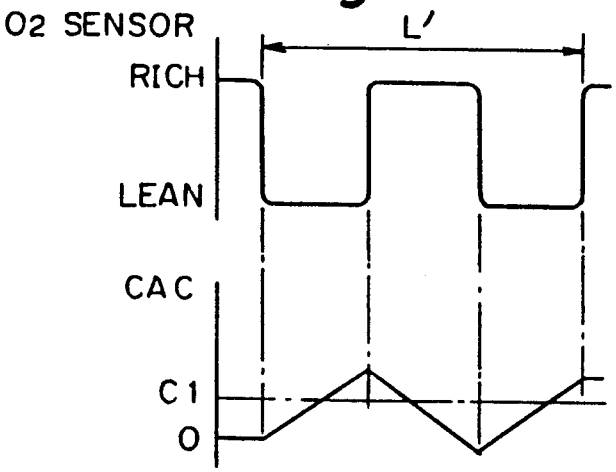

Conversely, as illustrated in FIG. 7(E), if the lean-rich discriminating time L, is determined so that it becomes equal to one and a half times the time in which the lean state or rich state occur, the lean time becomes longer than the rich time in the lean-rich discriminating time L'. Consequently, when the lean-rich discriminating time L' ends, the count value of the counter CAC becomes large. Therefore, if the routine for calculating the deposit learning coefficient is programmed to determine that, if the count value of the counter CAC exceeds C1 when the lean-rich discriminating time L ends, the air-fuel mixture becomes lean, the wrong determination is obviously made. To avoid this wrong determination, as illustrated in FIGS. 7(C) and (D), the lean-rich discriminating time L must be determined so that it becomes equal to a time in which the lean state or the rich state occur, as illustrated in FIG. 7(C) and (D).

As mentioned above, in the embodiment illustrated in FIG. 8, the lean-rich discriminating time L corresponds to the time in which the counter value of the counter CLRN 1 increases from A1 to B1. Accordingly, since the injecting operation of fuel is normally started at a predetermined crankangle, and the routine illustrated in FIGS. 9 and 10 is processed by sequential interruptions executed at every crankangle of 360°, the fuel injecting operation is carried out at fixed times regardless of the engine speed during the time in which the count value of the counter CLRN 1 increases from A1 to B1. Namely, the fuel injecting operation is effected at fixed times, regardless of the engine speed within the lean-rich discriminating time L. The air-fuel ratio of mixture changes each time the fuel injecting operation is carried out, and since the feedback control of the air-fuel ratio is carried out for such a change in the air-fuel ratio, the time in which the lean state or the rich state occurs depends on the number of fuel injections. Consequently, the lean-rich discriminating time L becomes approximately equal to a time in which the lean state and the rich state occur, regardless of the engine speed, i.e., regardless of the degree of acceleration.

Figure 7F:
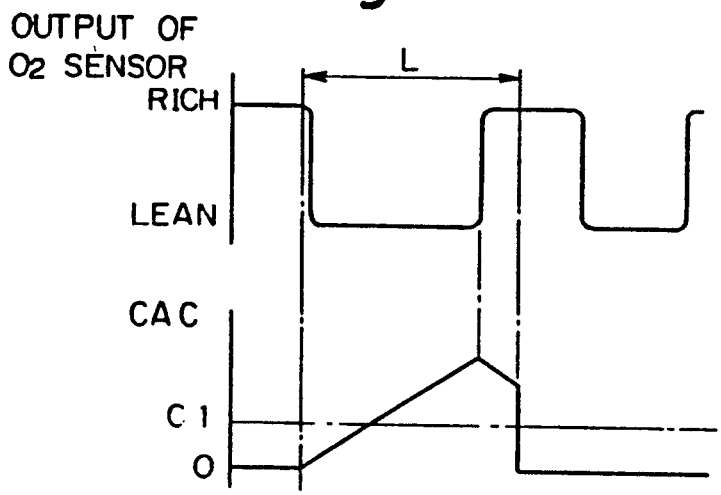
Figure 7G:
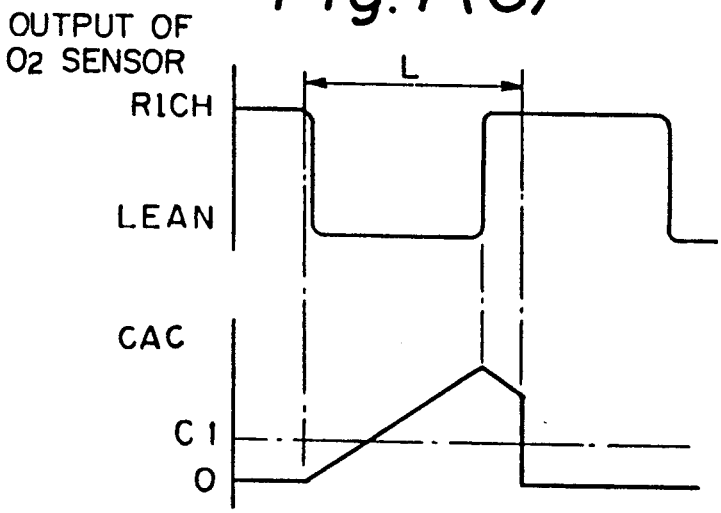
Figure 7H:
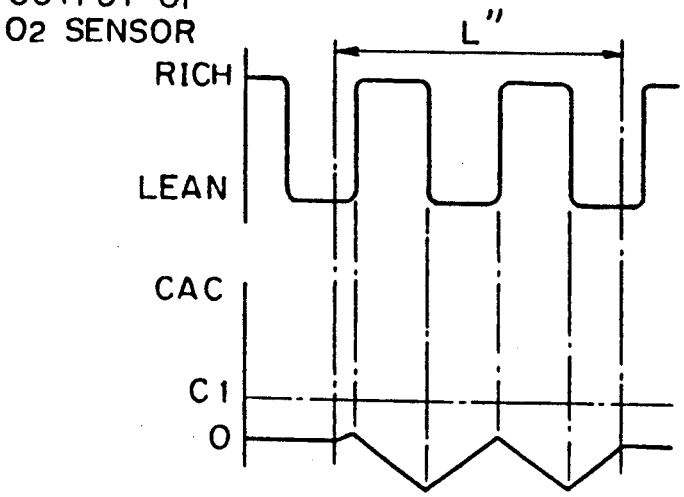

If the deposit is adhered to the inner wall of the intake port, etc., when the engine is accelerated, the air-fuel mixture becomes lean. Consequently, at this time, as illustrated in FIGS. 7(F) and (G), the lean time becomes long compared with the case illustrated in FIG. (C) and (D). Therefore, the lean time becomes longer than the rich time in the lean-rich discriminating time L, and thus when the lean-rich discriminating time L ends, the count value of the counter CAC becomes large. Consequently, it is possible to determine that the air-fuel mixture has become lean at the time of acceleration, because the count value of the counter CAC exceeds C1. As illustrated in FIGS. 7(F) and (G), when the lean-rich discriminating time L ends, the air-fuel mixture is in the rich time. This rich time becomes short as illustrated in FIG. 7(F), or becomes long as illustrated in FIG. 7(G), due to the control system for the fuel injection. But if the lean-rich discriminating time L is determined so that it becomes approximately equal to a time in which the lean state or the rich state occur, where a deposit is not adhered to the inner wall of the intake port, etc., it is possible to correctly determine that the air-fuel mixture has become lean due to the presence of the deposit, regardless of whether the rich time in which the lean-rich discriminating time L ends is short or long, as illustrated in FIGS. 7(F) or (G), respectively.

Where the control system for the fuel injection is constructed so that the rich time in which the lean-rich discriminating time L ends becomes short as illustrated in FIG. 7(F), it is possible to determine the lean-rich discriminating time L'' so that it becomes equal to an integral number of times, for example, twice as long as a time in which the lean time or the rich time occurs at the time of acceleration, where a deposit is not adhered to the inner wall of the intake port, etc., as illustrated in FIG. 7(H).

Figure 8:
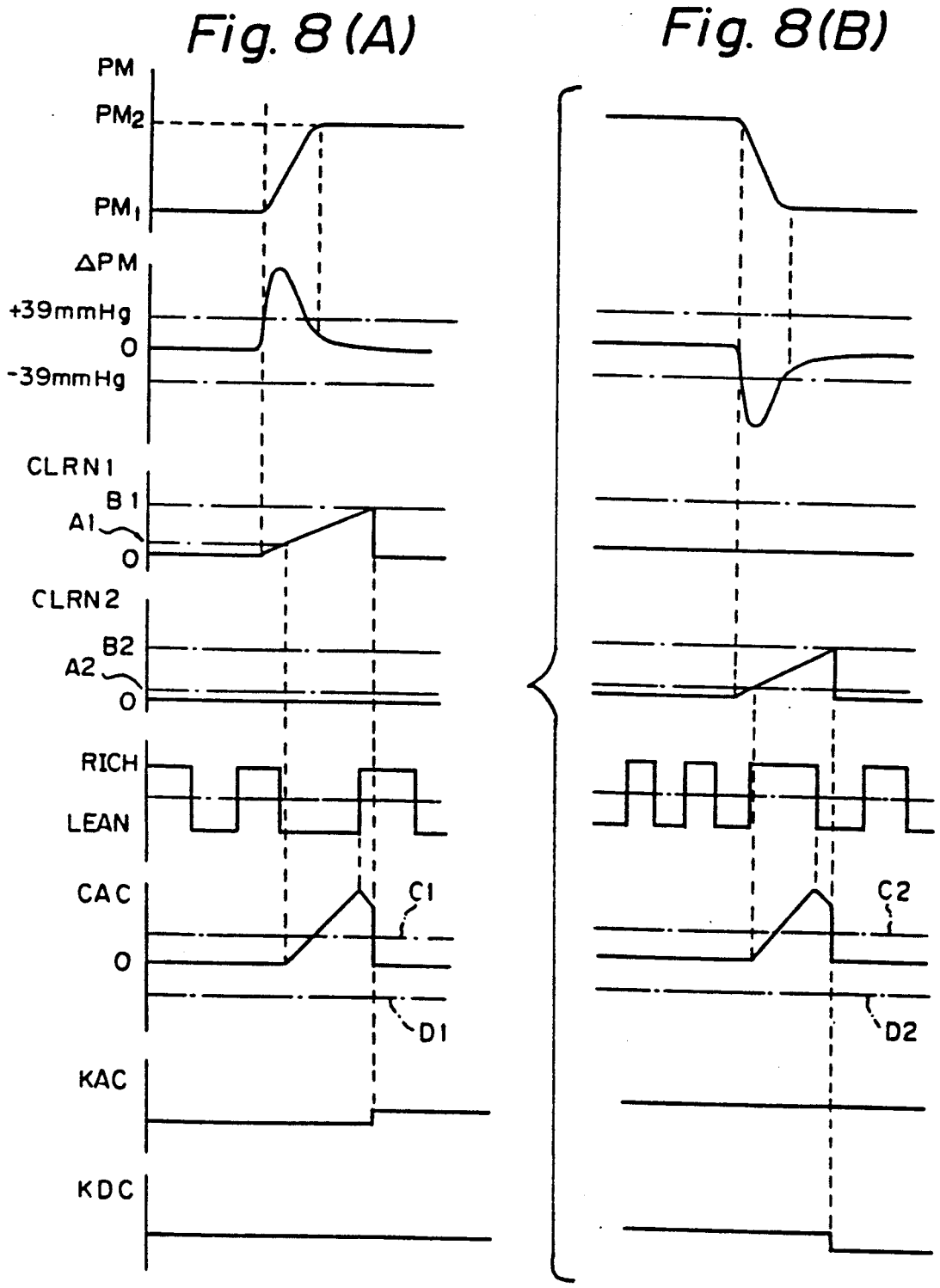
FIGS. 8*a* and 8*b* are a time chart illustrating a method of calculating the deposit learning coefficient.

As illustrated in FIG. 8, the discrimination of lean and rich is not carried out before the count value of the counter CLRN 1 reaches A1. This is because a fixed time must pass before the air-fuel mixture becomes an exhaust gas and then reaches the $O_2$ sensor 19.

Turning to FIG. 10, if it is determined in step 213 that the count value of the counter CLRN 1 becomes larger than B1, the routine goes to step 215 and it is determined whether or not the count value of the counter CAC is larger than a predetermined positive fixed value C1. If CAC $\leqq$ C1, the routine goes to step 216 and it is determined whether or not the count value of the counter CAC is smaller than a predetermined negative fixed value D1. If CAC $>$ D1, the routine goes to step 202 and the counters CAC, CLRN 1 and CLRN 2 are cleared. If it is determined in step 215 that the count value of the counter CAC is larger than C1, i.e., when the air-fuel mixture becomes lean at the time of acceleration, the routine goes to step 217, and in step 217 a predetermined fixed value, for example, 0.1, is added to the acceleration correction coefficient KAC, and thus the acceleration correction coefficient KAC is increased. Conversely, if it is determined in step 216 that the count value of the counter CAC is smaller than D1, the routine goes to step 218, and in step 218 a predetermined fixed value, for example, 0.1, is subtracted from the acceleration correction coefficient KAC, and thus the acceleration correction coefficient KAC is reduced. Turning to FIG. 9, when it is determined in step 206 that $\Delta PM$ is smaller than $-39$ mmHg, i.e., the decelerating operation of the engine has been carried out, the routine goes to step 219 and 1 is set in the counter CLRN 2. Then, the routine goes to the routine for calculating the fuel injection time. In the next processing cycle, the routine goes from step 204 to step 220, and it is determined whether or not $\Delta PM$ has become larger than 5 mmHg, i.e., the engine has been accelerated after the decelerating operation of the engine is started. If $\Delta PM < 5$ mmHg, the routine goes to step 202 and the counters CAC, CLRN 1 and CLRN 2 are cleared.

Conversely, when the decelerating operation of the engine is continuously carried out, since $\Delta PM$ becomes smaller than 5 mmHg, the routine goes from step 220 to step 221 and the counter CLRN 2 is incremented by one. That is, as illustrated in FIG. 8(B), when the decelerating operation of the engine is started, and the absolute pressure PM decreases from $PM_2$ to $PM_1$, if $\Delta PM$ becomes smaller than $-39$ mmHg, the count up operation of the counter CLRN 2 is started.

Then, in step 222 it is determined whether or not the count value of the counter CLRN 2 exceeds a predetermined fixed value A2. If CLRN 2 $<$ A2, the routine goes to the routine for calculating the fuel injection time. When CLRN 2 exceeds A2, the routine goes to step 233 and it is determined from the output signal of the $O_2$ sensor 19 whether or not the air-fuel mixture fed into the engine cylinder is rich. When the air-fuel mixture is rich, the routine goes to step 224 and the counter CAC is incremented by one. Then the routine goes to step 225. When the air-fuel mixture is not rich, i.e., is lean, the routine goes to step 226 and the counter CAC is decremented by one. Then the routine goes to step 225. In step 225, it is determined whether or not the count value of the counter CLRN 2 exceeds a predetermined fixed value B2. If CLRN 2 < B2, the routine goes to the routine for calculating the fuel injection time. That is, as illustrated in FIG. 8(B), it is determined whether the air-fuel mixture is rich or lean during the time in which the count value of the counter CLRN 2 increases from A2 to B2, i.e., within the lean-rich discriminating time for the decelerating operation, which is the same as the lean-rich discriminating time L illustrated in FIG. 7(C). During this time, when the air-fuel mixture becomes rich, the counter CAC is counted up, and when the air-fuel mixture becomes lean, the counter CAC is counted down. Thus, during the time in which the count value of the counter CLRN 2 increases from A2 to B2, i.e., within the lean-rich discriminating time, if the rich time becomes longer than the lean time, the count value of the counter CAC is increased, and if the lean time becomes longer than the rich time, the count value of the counter CAC is reduced. Consequently, from the count value of the counter CAC at the moment when the count valve of the counter CLRN 2 reaches B2, it is possible to determine whether the air-fuel mixture has become rich or lean at the time of deceleration.

In step 225, if it is determined that the count value of the counter CLRN 2 becomes larger than B2, the routine goes to step 227 and it is determined whether or not the count value of the counter CAC is larger than a predetermined positive fixed value C2. If CAC = C2, the routine goes to step 228 and it is determined whether or not the count value of the counter CAC is smaller than a predetermined negative fixed value D2. If CAC > D2, the routine goes to step 202 and the counters CAC, CLRN 1 and CLRN 2 are cleared. If it is determined in step 227 that the count value of the counter CAC is larger than C2, i.e., when the air-fuel mixture becomes rich at the time of deceleration, the routine goes to step 229, and in step 229, a predetermined fixed value, for example, 0.1, is added to the deceleration correction coefficient KDC, and thus the deceleration correction coefficient KDC is increased. Conversely, if it is determined in step 228 that the count value of the counter CAC is smaller than D2, the routine goes to step 230, and in step 230, a predetermined fixed value, for example, 0.1, is subtracted from the deceleration correction coefficient KDC, and thus the deceleration correction coefficient KDC is reduced.

The acceleration correction coefficient KAC and the deceleration correction coefficient KDC represent the correction coefficient K for the correction fuel injection time TPAEW due to the presence of the deposit. Consequently, if the air-fuel mixture becomes lean at the time of acceleration due to the presence of the deposit, the correction coefficient K is increased, and if the air-fuel mixture becomes rich at the time of deceleration due to the presence of the deposit, the correction coefficient K is also increased. The acceleration correction coefficient KAC and the deceleration correction coefficient KDC are stored in the back-up RAM 33*a*.

Figure 11:
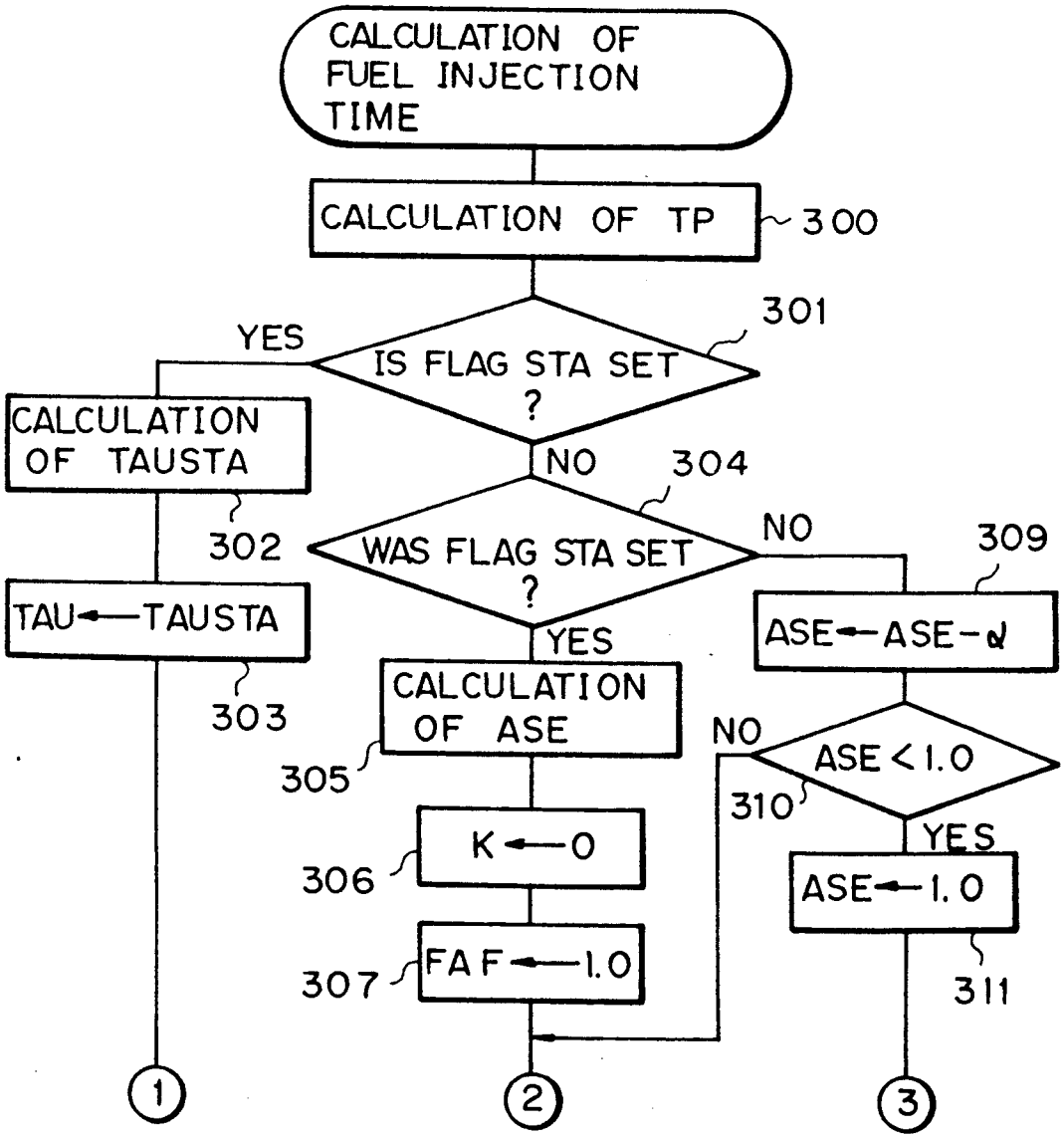
FIGS. 11 and 12 are flow charts for calculating the fuel injection time.
Figure 12:
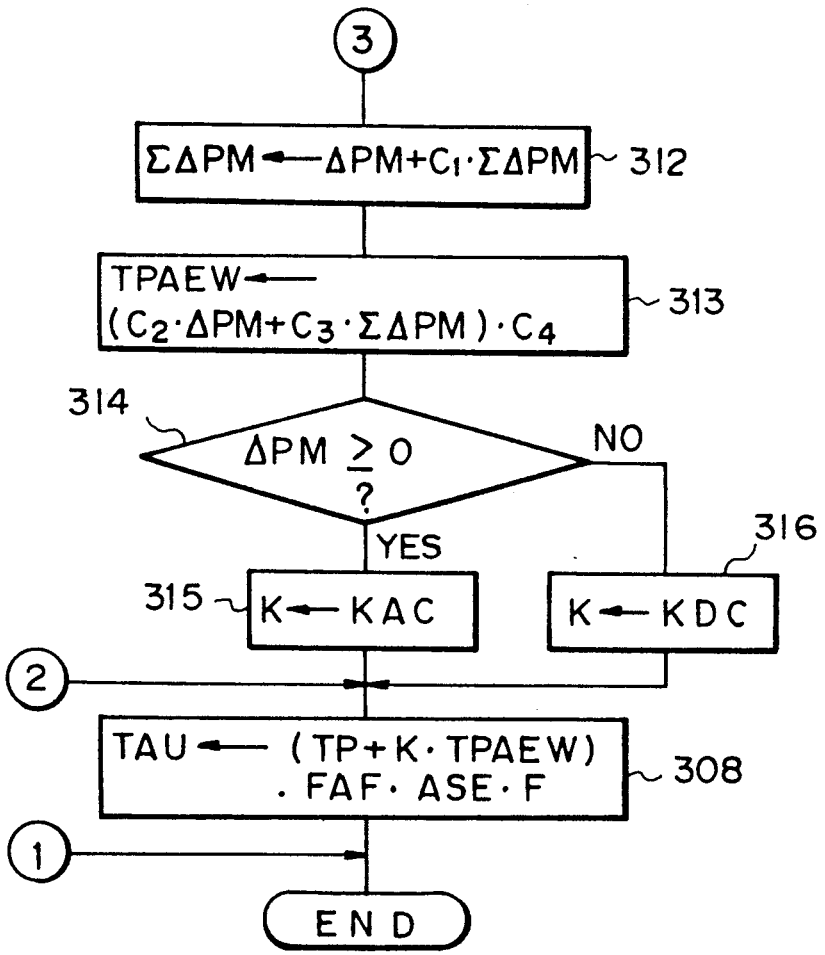
Figure 13:
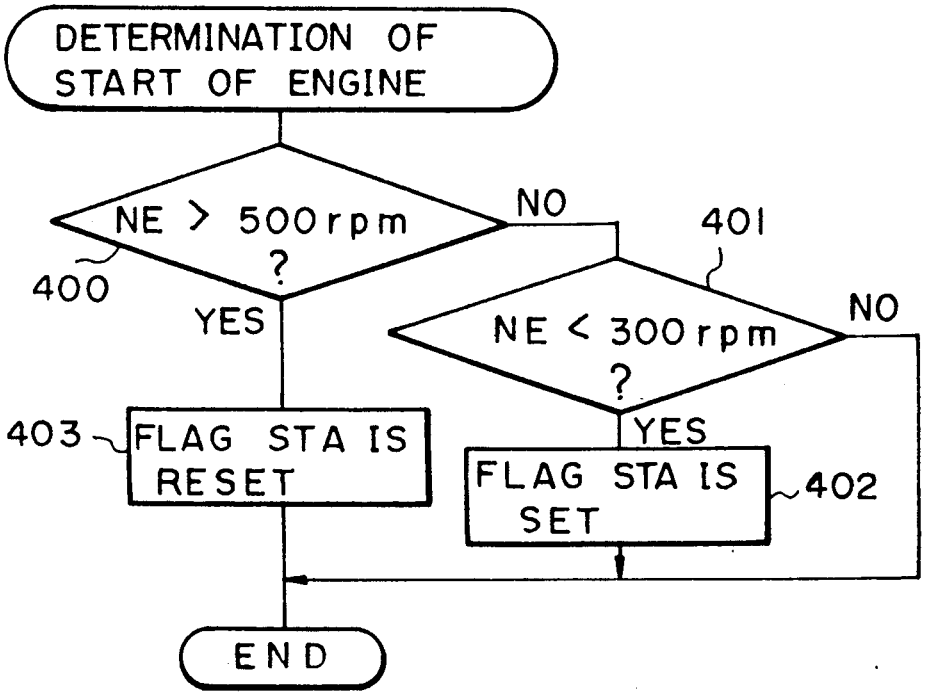
FIG. 13 is a flow chart for determining the start of the engine.
Figure 15:
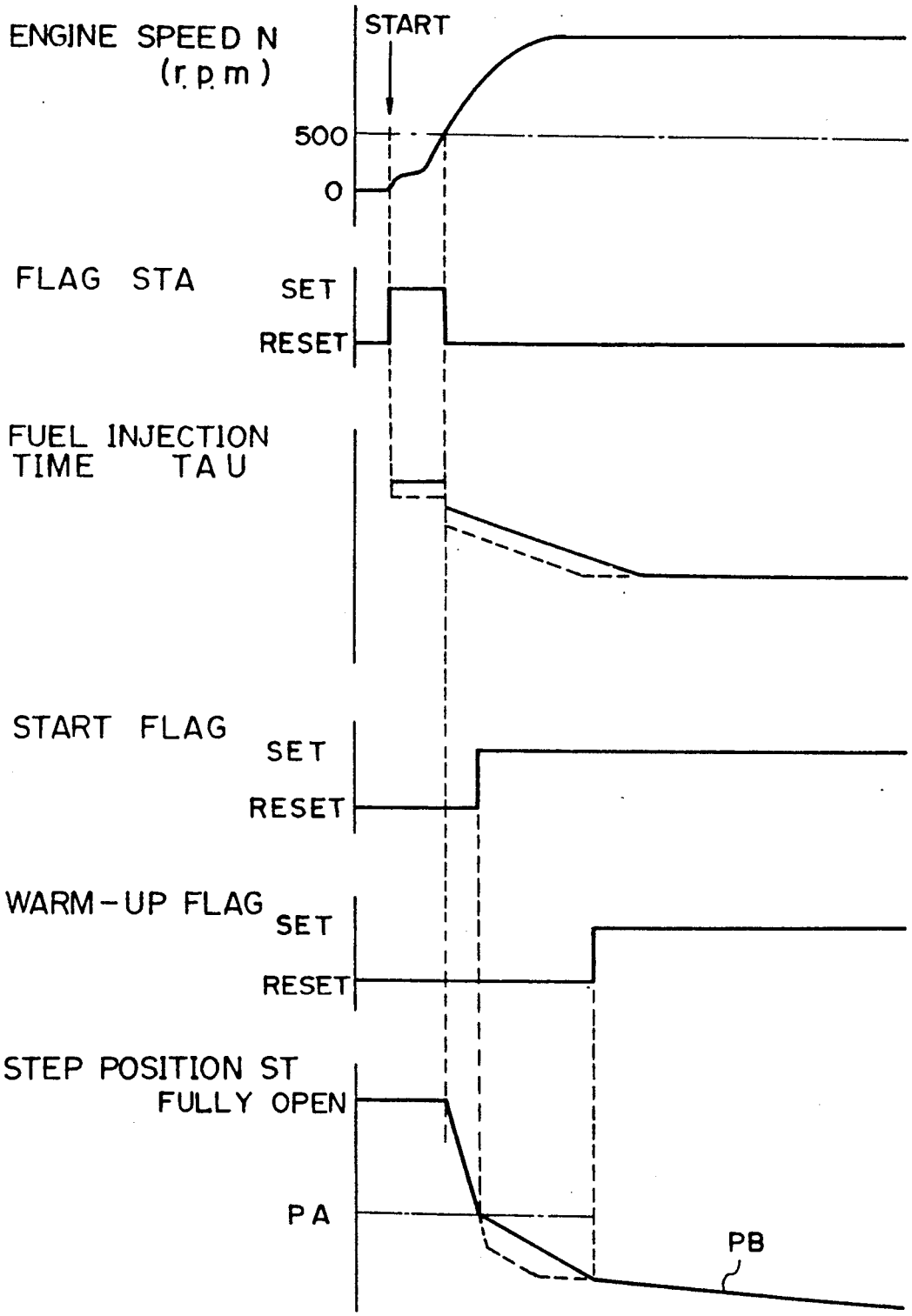
FIG. 15 is a time chart illustrating the controls of the fuel injection and the step motor.

FIGS. 11 and 12 illustrate a routine for calculating the fuel injection time, which routine is executed successively after the execution of the routine illustrated in FIGS. 9 and 10. FIG. 13 illustrates a routine for determining whether or not the engine has been started, and FIG. 15 illustrates a time chart at the time of starting the engine. Next, the routine for the determination of the starting of the engine, illustrated in FIG. 13, will be described before describing the routine for calculating the fuel injection time. The routine illustrated in FIG. 13 is processed by sequential interruptions executed at every 360 degrees of crankangle.

Referring to FIG. 13, in step 400 it is determined, on the basis of the output signal of the engine speed sensor 23, whether or not the engine speed NE exceeds a fixed value, for example, 500 r.p.m. If NE ≦ 500 r.p.m, the routine goes to step 401 and it is determine whether or not the engine speed NE is lower than a fixed value, for example, 300 r.p.m. If NE < 300 r.p.m., the routine goes to step 402 and the flag STA is set. Conversely, if NE ≧ 350 r.p.m., the processing cycle is completed. If the engine speed NE exceeds 500 r.p.m, the routine goes from step 400 to step 403 and the flag STA is reset. Consequently, as illustrated in FIG. 15, when the starter motor (not shown) is operated and the rotation of the engine is started, the flag STA is set. Thereafter, once the engine speed NE exceeds 500 r.p.m., it is determined that the engine has been started and the flag STA is reset.

Next, the routine for calculating the fuel injection time will be described with reference to FIGS. 11 and 12.

Figure 16A:
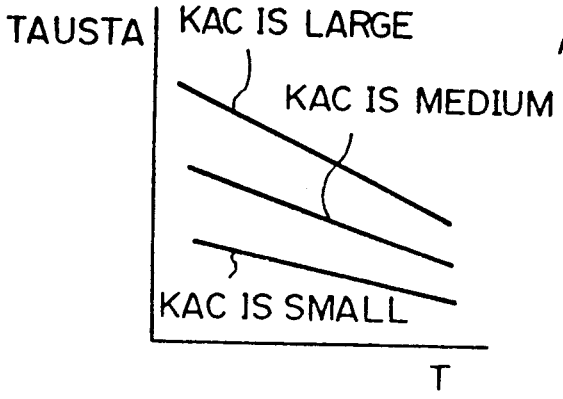
FIGS. 16(*a–d*) are a diagram illustrating the fuel injection time, etc.

Referring to FIGS. 11 and 12, in step 300 the basic fuel injection time TP is calculated from the output signals of the absolute pressure sensor 21 and the engine speed sensor 23. Then, in step 301 it is determined whether or not the flag STA is set. If the flag STA is set, i.e., before the engine speed NE reaches 500 r.p.m. after the engine is driven by the starter motor, the routine goes to step 302 and the amount of fuel TAUSTA to be injected before the engine rotates under its own power is calculated on the basis of the relationship illustrated in FIG. 16(A). As illustrated in FIG. 16(A), this TAUSTA is a function of both the temperature T of the engine coolant and the acceleration correction coefficient KAC. This TAUSTA becomes large as the temperature T of the engine coolant becomes low, and this TAUSTA becomes large as the acceleration correction coefficient KAC becomes large, i.e., as the amount of the deposit is increased. Then, in step 303, TAUSTA is memorized as TAU, and fuel is injected from the fuel injector 12 for the time determined by TAU.

Figure 16B:
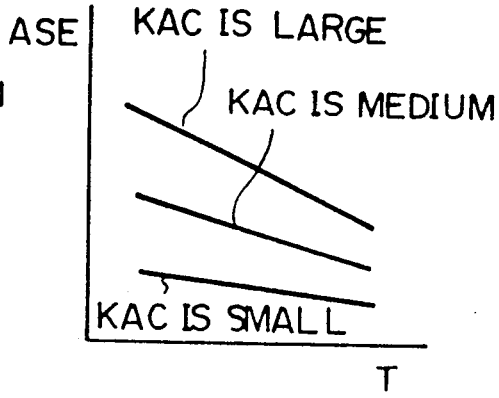

If the engine speed NE exceeds 500 r.p.m. and thus the flag STA is reset, the routine goes from step 301 to step 304 and it is determined whether or not the flag STA was set in the preceding processing cycle. When the routine initially goes to step 304 after the engine is started, since the flag STA was set in the preceding processing cycle, the routine goes to step 305 and the fuel injection correction coefficient ASE at the time of starting the engine is calculated on the basis of the relationship illustrated in FIG. 16(B). As illustrated in FIG. 16(B), this ASE is a function of both the temperature T of the engine coolant and the acceleration correction coefficient KAC. This ASE becomes large as the temperature T of the engine coolant becomes low, and becomes large as the acceleration correction coefficient KAC becomes large, i.e., as the amount of the deposit is increased. The relationships illustrated in FIGS. 16(A) and (B) are stored in the ROM 32. Then, in step 306 the correction coefficient K is made zero, and in step 307, the feedback correction coefficient FAF is made 1.0. Then the fuel injection time TAU is calculated in step 308.

In the next processing cycle, the routine goes from step 304 to step 309, and a predetermined fixed value $\alpha$ is substracted from ASE. Then in step 310 it is determined whether or not ASE has become lower than 1.0, and if ASE $\geqq$ 1.0, the routine goes to step 308 and the fuel injection time TAU is calculated. Consequently, when the engine is started the fuel injection time TAU is gradually reduced as illustrated in FIG. 15. In FIG. 15, the solid line indicates the fuel injection time where the deposit is adhered to the inner wall of the intake port, etc, and the broken line indicates the fuel injection time where the deposit is not adhered to the inner wall of the intake part, etc. Consequently, as can seen from FIG. 15, when the deposit is adhered to the inner wall of the intake port, etc, the amount of fuel injected by the fuel injector 12 before and immediately after the engine is started is increased.

If it is determined in step 310 that SAE is lower than 1.0, the routine goes to step 311 and ASE is made 1.0. Then, in step 312 $\Sigma\Delta PM$ is calculated from the following equation.

$$\Sigma\Delta PM = \Delta PM + C_1\Sigma\Delta PM \quad (5)$$

Then in step 313 the correction fuel injection time TPAEW is calculated from the following equation.

$$TPAEW = (C_2 \cdot \Delta PM + C_3 \cdot \Sigma\Delta PM) \cdot C_4 \quad (6)$$

If the above equations (5) and (6) are combined, the resulting equation becomes as follows.

$$TPAEW = \{C_2 \cdot \Delta PM + C_3 \cdot (\Delta PM + C_1\Sigma\Delta PM)\} \cdot C_4$$

This equation represents the above-mentioned equation (3), and thus represents an increase or a reduction in the amount of fuel necessary to maintain the air-fuel ratio of the mixture at the stoichiometric air-fuel ratio in a transition operating state, where a deposit is not adhered to the inner wall of the intake port, etc.

Then, in step 314 it is determined whether or not $\Delta PM$ is positive or equal to zero. When it is determined in step 314 that $\Delta PM$ is equal to zero, or it is determined that $\Delta PM$ is positive, i.e., the accelerating operation of the engine is carried out, the routine goes to step 315, and the acceleration correction coefficient KAC is memorized as the correction coefficient K. Then the routine goes to step 308. Conversely, when it is determined in step 314 that $\Delta PM$ is negative, i.e., the decelerating operation of the engine is carried out, the routine goes to step 316, and the deceleration correction coefficient KDC is memorized as the correction coefficient K. Then the routine goes to step 308.

In step 308, the fuel injection time TAU is calculated from the following equation.

$$TAU = (TP + K \cdot TPAEW) \cdot FAF \cdot ASE \cdot F$$

If the air-fuel mixture becomes lean at the time of acceleration due to the presence of the deposit, the correction coefficient K is increased. Consequently, when the next accelerating operation is carried out, since K·TPAEW, i.e., the acceleration increasing rate of the amount of fuel is increased, the air-fuel ratio of mixture is maintained at the stoichiometric air-fuel ratio. Conversely, if the air-fuel mixture becomes rich at the time of deceleration due to the presence of the deposit, the correction coefficient K is increased. Consequently, when the next decelerating operation is carried out, since K·TPAEW, i.e., the deceleration reducing rate of the amount of fuel is increased, the air-fuel ratio of mixture is maintained at the stoichiometric air-fuel ratio. Therefore, even if the deposit is adhered to the inner wall of the intake port, etc., it is possible to maintain the air-fuel ratio of mixture at the stoichiometric air-fuel ratio regardless of the operating state of the engine.

Next, the routine for controlling the step motor 17*a* of the bypass air control valve 17 will be described with reference to FIG. 14. This routine is processed by sequential interruptions executed at predetermined intervals, for example, every 2 msec. The present step position ST of the step motor 17*a* is stored in the RAM 33 and, in the embodiment illustrated in FIG. 14, the opening area of the bypass air control valve 17 is increased as the numeral representing the step position ST becomes large. The step motor 17*a* is controlled by the routine (not shown) so that the step position ST becomes equal to the maximum step position, i.e., the fully open step position, in which the bypass air control valve 17 is fully open when the engine is stepped. Therefore, the bypass air control valve 17 is maintained at the fully open position before the engine is started.

Figures 14, 14A, 14B:
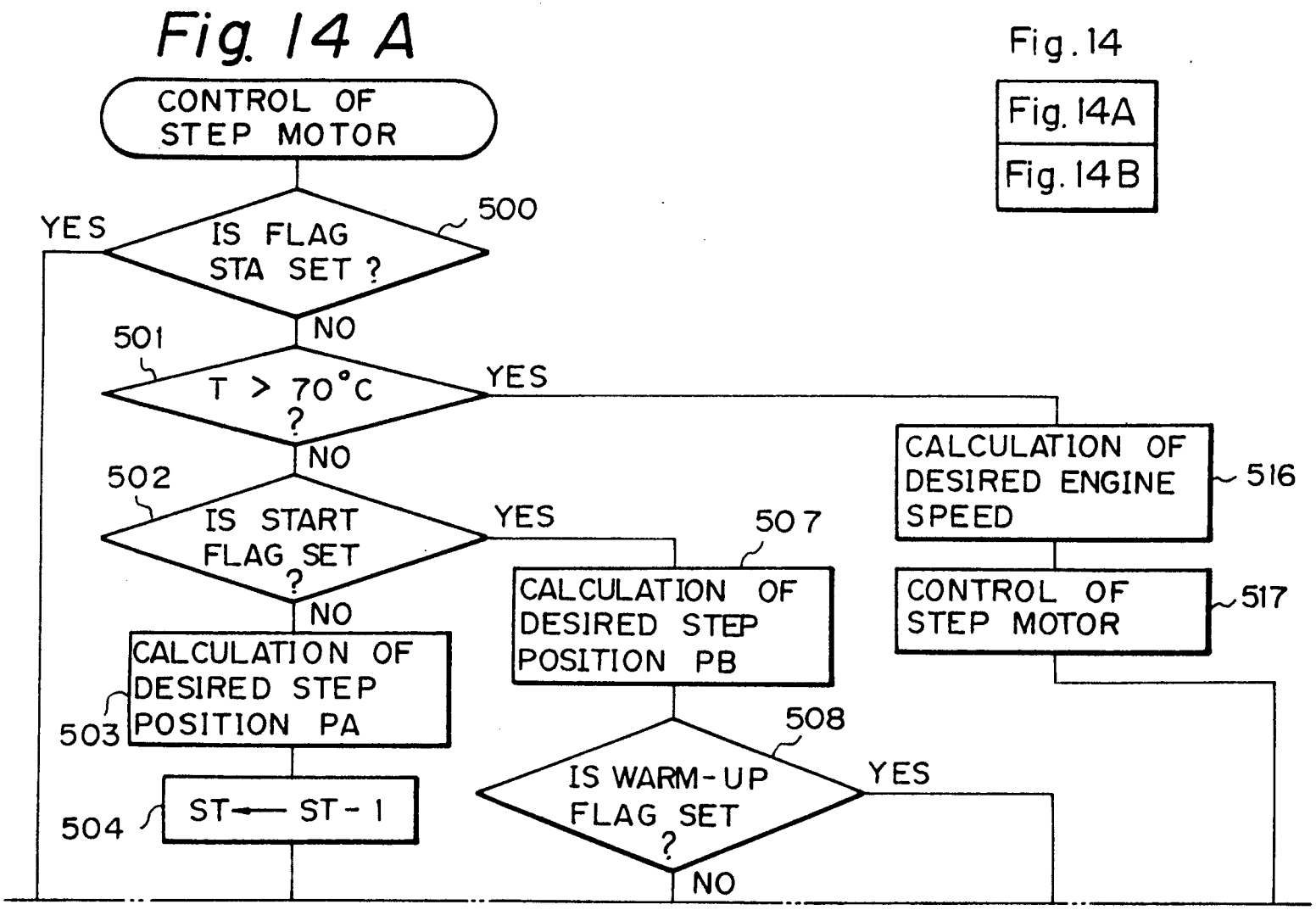
FIGS. 14, 14*a*, and 14*b* are a flow chart for controlling the step motor.
Figure 14B:
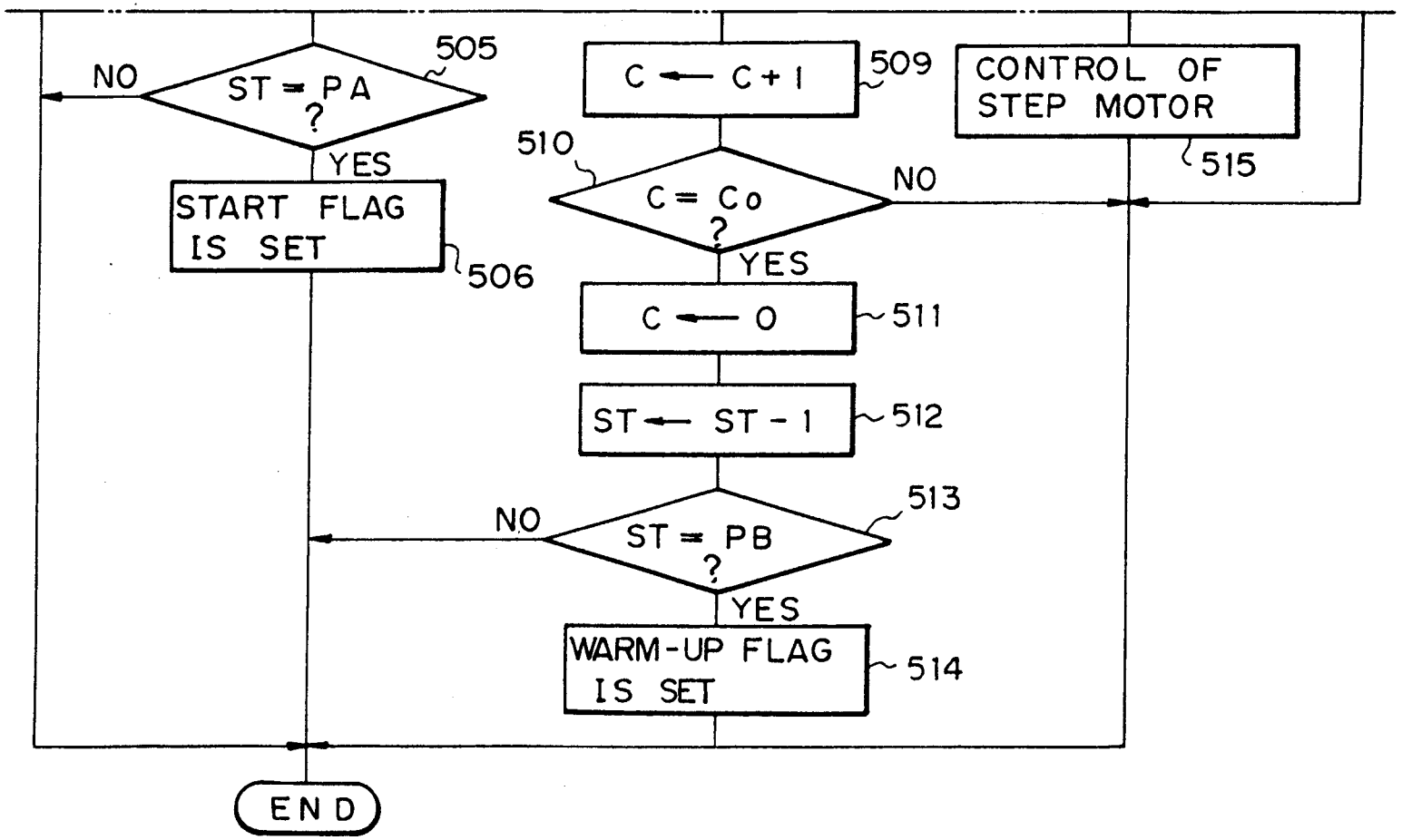

Referring to FIG. 14, in step 500 it is determined whether or not the flag STA is set. If the flag STA is set, the processing cycle is completed. Consequently, at this time, the step position ST of the step motor 17*a* is maintained at the fully open position as illustrated in FIG. 15.

Figure 16C:
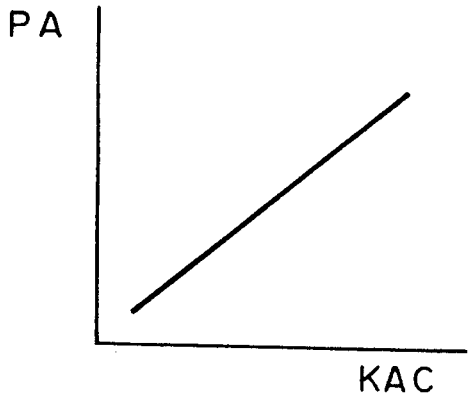

If the flag STA is reset, the routine goes to step 501 and it is determined whether or not the temperature T of the engine coolant exceeds a predetermined fixed value, for example, 70° C. If T < 70° C., the routine goes to step 502 and it is determined whether or not the start flag is set. At this time, since the start flag is reset, the routine goes to step 503 and the desired step position PA is calculated from the relationship illustrated in FIG. 16(C). As illustrated in FIG. 16(C), this PA is a function of the acceleration correction coefficient KAC, and becomes larger as the acceleration correction coefficient KAC becomes larger, i.e., as the amount of the deposit is increased. The relationship illustrated in FIG. 16(C) is stored in the ROM 32.

Then, in step 504 the step position ST of the step motor 17*a* is decremented by one, and accordingly, the step motor 17*a* is rotated by one step in a direction in which the bypass air control valve 17 is closed. Then, in step 505 it is determined whether or not the step position ST has reached the desired step position PA. If the step position ST has reached the desired step position PA, the routine goes to step 506 and the start flag is set. Consequently, as illustrated in FIG. 15, when the flag STA is reset, the step motor is rotated at a high speed from the fully open position to the desired step position PA.

Figure 16D:
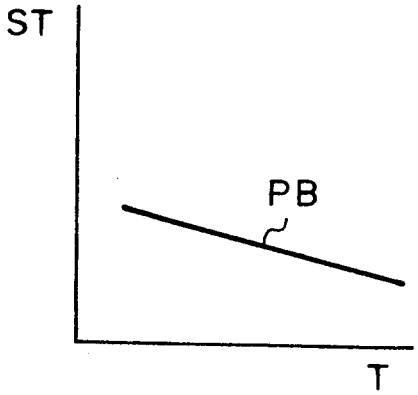

If the start flag is set, the routine goes from step 502 to step 507 and the desired step position PB at the time of warm-up of the engine is calculated. As illustrated in FIG. 16(D), this PB is a function of the temperature T of the engine coolant and becomes larger as the temperature T of the engine coolant becomes lower. The relationship illustrated in FIG. 16(D) is stored in the ROM 32 and thus, in step 507, the desired step position PB is calculated from this relationship stored in the ROM 32.

Then, in step 508 it is determined whether or not the warm-up flag is set. At this time, since the warm-up flag is reset, the routine goes to step 509 and the count value C is incremented by one. Then, in step 510 it is determined whether or not the count value C has become equal to a predetermined fixed value Co, for example, 8. If the count value C has become equal to Co, the routine goes to step 55 and the count value C is made zero. Then, in step 512 the step position ST of the step motor 17*a* is decremented by one, and accordingly, the step motor 17*a* is rotated by one step in a direction in which the bypass air control valve 17 is closed. Then, in step 513 it is determined whether or not the step position ST has reached the desired step position PB. If the step position ST has reached the desired step position PB, the routine goes to step 514 and the warm-up flag is set. Consequently, as illustrated in FIG. 15, when the start flag is set, the step motor is rotated at a relatively low speed from the desired step position PA to the desired step position PB.

If the warm-up flag is set, the routine goes from step 508 to step 515 and the step motor 17*a* is controlled so that the step position ST becomes equal to the desired step position PB.

When the temperature T of the engine coolant exceeds 70° C., the routine goes to step 516 and the desired idling speed is calculated. Then, in step 517 the step motor 17*a* is controlled so that the idling speed becomes equal to the desired idling speed.

In the step position ST in FIG. 15, the solid line indicates the step position where the deposit is adhered to the inner wall of the intake port, etc., and the broken line indicates the step position ST where the deposit is not adhered to the inner wall of the intake port, etc. Consequently, as can be seen from FIG. 15, if the deposit is adhered to the inner wall of the intake port, etc., the step position ST of the step motor 17*a* immediately after the engine is started becomes large, and since the amount of air flowing within the bypass passage 16 is increased, the idling speed of the engine becomes high. If the idling speed becomes high, the velocity of air flowing within the intake port 7 becomes high, and as a result, since the amount of fuel fed into the engine cylinder is increased, it is possible to prevent the air-fuel mixture from becoming overlean.

In addition, instead of using the bypass air control valve 17, by increasing the degree of opening of the throttle valve 15 immediately after the engine is started, the idling speed of the engine may be increased.

According to the present invention, when the deposit is adhered to the inner wall of the intake port, etc., it is possible to prevent the air-fuel mixture from becoming over lean by increasing the amount of air fed into the engine cylinder at the time of starting the engine, and as a result, it is possible to obtain an easy start of the engine and a subsequent stable operation of the engine.

While the invention has been described by reference to a specific embodiments chosen for purposes of illustration, it should be apparent that numerous modifications could be made thereto by those skilled in the art without departing from the basic concept and scope of the invention.

We claim:

1. An idling speed control device of an engine having an intake passage and an exhaust passage, said device comprising:

an oxygen concentration detector arranged in the exhaust passage and producing an output signal indicating whether an air-fuel mixture fed into the engine is lean or rich;

feedback control means for controlling an amount of fuel fed into the engine in response to the output signal of said oxygen concentration detector, to bring an air-fuel ratio of the mixture to a desired air-fuel ratio;

acceleration detecting means for detecting an accelerating operation of the engine;

time calculating means for calculating a lean time and a rich time of the air-fuel mixture on the basis of the output signal of said oxygen concentration detector during a predetermined lean-rich discriminating time when the accelerating operation of the engine is carried out;

difference calculating means for calculating a difference between said lean time and said rich time;

start detecting means for detecting a starting operation of the engine; and idling speed control means for controlling an idling speed of the engine when the engine is started to increase said idling speed when said lean time is longer than said rich time and when said difference is larger than a predetermined value, and to reduce said idling speed when said rich time is longer than said lean time and when said difference is larger than a predetermined value.

2. An idling speed control device according to claim 1, wherein said idling speed control means controls an amount of air fed into the engine to control said idling speed.

3. An idling speed control device according to claim 2, wherein said idling speed control device comprises a bypass air passage bypassing a throttle valve arranged in the intake passage, and a bypass air control valve arranged in said bypass air passage to control an amount of air flowing within said bypass air passage.

4. An idling speed control device according to claim 3, wherein said bypass air control valve is closed from a fully open position to a predetermined first position at a predetermined first speed when the engine is started, and said bypass air control valve is closed from said predetermined first position to a predetermined second position at a predetermined second speed which is lower than said predetermined first speed, said predetermined first position being moved toward said fully open position when said lean time is longer than said rich time and when said difference is larger than a predetermined value, said predetermined first position being moved away from said fully open position when said rich time is longer than said lean time and when said difference is larger than a predetermined value.

5. An idling speed control device according to claim 4, wherein said predetermined first position is controlled by a correction coefficient which is increased each time said lean time is longer than said rich time and said difference is larger than a predetermined value, said correction coefficient being decreased each time said rich time is longer than said lean time and said difference is larger than a predetermined value.

6. An idling speed control device according to claim 5, wherein said predetermined first position is moved toward said fully open position as said correction coefficient becomes larger.

7. An idling speed control device according to claim 4, wherein said predetermined second position is a function of a temperature of an engine coolant.

8. An idling speed control device according to claim 7, wherein said predetermined second position is moved toward said fully open position as the temperature of said engine coolant becomes lower.

9. An idling speed control device according to claim 4, wherein it is determined that the engine is started when an engine speed exceeds a predetermined speed.

10. An idling speed control device according to claim 4, wherein a closing operation of said bypass air control valve toward said predetermined first position and then toward said predetermined second position is carried out when a temperature of an engine coolant is lower than a predetermined temperature, and said bypass air control valve is controlled so that an engine speed becomes equal to a predetermined idling speed when the temperature of said engine coolant is higher than said predetermined temperature.

11. An idling speed control device according to claim 1, further comprising enrichment means for increasing the amount of fuel fed into the engine when the engine is started; and enrichment correction means for correcting an increase in the amount of fuel, which increase is caused by said enrichment means, to increase said increase in the amount of fuel when said lean time is longer than said rich time and when said difference is larger than a predetermined value, and to reduce said increase in the amount of fuel when said rich time is longer than said lean time and when said difference is larger than a predetermined value.

12. An idling speed control device according to claim 11, wherein said increase in the amount of fuel becomes equal to a predetermined first increase before the engine rotates under its own power, and said increase in the amount of fuel is gradually reduced from a predetermined second increase after the engine is rotating under its own power, said predetermined first increase and said predetermined second increase being increased when said lean time is longer than said rich time and when said difference is larger than a predetermined value, said predetermined first increase and said predetermined second increase being reduced when said rich time is longer than said lean time and when said difference is larger than a predetermined value.

13. An idling speed control device according to claim 12, wherein said predetermined first increase and said predetermined second increase are controlled by a correction coefficient which is increased each time said lean time is longer than said rich time and said difference is larger than a predetermined value, said correction coefficient being reduced each time said rich time is longer than said lean time and said difference is larger than a predetermined value, said predetermined first increase and said predetermined second increase being increased as said correction coefficient becomes larger.

14. An idling speed control device according to claim 12, wherein said predetermined first increase and said predetermined second increase are a function of a temperature of an engine coolant and are increased as the temperature of said engine coolant becomes lower.

15. An idling speed control device according to claim 12, wherein it is determined that the engine is rotating under its own power when an engine speed exceeds a predetermined speed.

16. An idling speed control device according to claim 1, further comprising:

fuel increasing means for increasing the amount of fuel fed into the engine when the accelerating operation of the engine is carried out; and correction means for correcting an increase in the amount of fuel, which increase is caused by said fuel increasing means, to increase said increase in the amount of fuel when said lean time is longer than said rich time and when said difference is larger than a predetermined value, and to reduce said increase in the amount of fuel when said rich time is longer than said lean time and when said difference is larger than a predetermined value, said lean-rich discriminating time being an integral number of times of a time of the occurrence of either one of said lean time and said rich time when the air-fuel ratio of mixture is maintained at the desired air-fuel ratio due to an increase in the amount of fuel by said fuel increasing means.

17. An idling speed control device according to claim 16, wherein said lean-rich discriminating time is a fixed value which is stored in a memory.

18. An idling speed control device according to claim 17, wherein said lean-rich discriminating time is determined on the basis of a time frequency of an occurrence of either one of said lean time and said rich time when a cruising operation of the engine is carried out.

19. An idling speed control device according to claim 18, wherein said lean-rich discriminating time is slightly shorter than a time of an occurrence of either one of said lean time and said rich time when the cruising operation of the engine is carried out.

20. An idling speed control device according to claim 16, wherein said increase in the amount of fuel by said fuel increasing means is increased for a short time after the accelerating operation of the engine is started, and a reduction in said increase in the amount of fuel is begun after said short time has elapsed and continues even after the accelerating operation of the engine is completed.

21. An idling speed control device according to claim 20, wherein said increase in the amount of fuel is controlled on the basis of a rate of change of an engine load, and said increase in the amount of fuel is increased when said rate of change is relatively high, said increase in the amount of fuel being reduced when said rate of change is relatively low.

22. An idling speed control device according to claim 21, wherein said engine load is represented by an absolute pressure PM in the intake passage.

23. An idling speed control device according to claim 21, wherein said increase in the amount of fuel is calculated from the following equation.

$$TPAEW=\{C_2\cdot\Delta L+C_3\cdot(\Delta L+C_1\cdot\Sigma\Delta L)\}\cdot C_4$$

where

TPAEW: said increase in the amount of fuel

ΔL: aid rate of change the engine load $C_1$, $C_2$, $C_3$, $C_4$: coefficients

24. An idling speed control device according to claim 23, wherein said correction means corrects said TPAEW.

25. An idling speed control device according to claim 16, further comprising: deceleration detecting means for detecting a decelerating operation of the engine; fuel decreasing means for decreasing the amount of fuel fed into the engine when the decelerating operation of the engine is carried out; time calculating means used during a deceleration operation for calculating a lean time and a rich time of the air-fuel mixture on the basis of the output signal of said oxygen concentration detector during a predetermined lean-rich discriminating time when the decelerating operation of the engine is carried out; and correction means used during a deceleration operation for correcting a decrease in the amount of fuel, which decrease is caused by said fuel decreasing means, to increase said decrease in the amount of fuel when said rich time is longer than said lean time and when said difference is larger than a predetermined value, and to reduce said decrease in the amount of fuel when said lean time is longer than said rich time and when said difference is larger than a predetermined value.

26. An idling speed control device according to claim 25, wherein said decrease in the amount of fuel by said fuel decreasing means is increased for a short time after the decelerating operation of the engine is started, and a reduction in said decrease in the amount of fuel is begun after said short time has elapsed and continues even after the decelerating operation of the engine is completed.

27. An idling speed control device according to claim 26, wherein said decrease in the amount of fuel is controlled on the basis of a rate of change of an engine load, and said decrease in the amount of fuel is increased when said rate of change is relatively high, said decrease in the amount of fuel being reduced when said rate of change is relatively low.

28. An idling speed control device according to claim 27, wherein said engine load is represented by an absolute pressure PM in the intake passage.

29. An idling speed control device according to claim 27, wherein said decrease in the amount of fuel is calculated from the following equation.

$$TPAEW=\{C_2 \cdot L+C_3 \cdot (\Delta L+C_1 \cdot \Sigma \Delta L)\} \cdot C_4$$

where

TPAEW: said decrease in the amount of fuel $\Delta L$: rate of change of the engine load $C_1$, $C_2$, $C_3$, $C_4$ : coefficients

30. An idling speed control device according to claim 29, wherein said correction means used during a deceleration operation corrects said TPAEW.

* * * * *

UNITED STATES PATENT AND TRADEMARK OFFICE
CERTIFICATE OF CORRECTION

PATENT NO. : 5,018,494

DATED : May 28, 1991

INVENTOR(S) : Yukihiro Sonoda, et al.

It is certified that error appears in the above-identified patent and that said Letters Patent is hereby corrected as shown below:

Column 1, line 24, insert a comma after "increased".

Column 2, line 54, delete the comma after "started".

Column 3, line 46, insert a comma after "started".

Column 4, line 6, change "is a diagram" to --are diagrams--.

Column 4, line 8, change "a time chart" to --time charts--.

Column 4, line 16, change "a flow chart" to --flow charts--.

Column 4, line 20, change "is a diagram" to --are diagrams--.

Column 5, line 49, change "ratio At" to --ratio. At--.

Column 9, line 5, change "$C_1 \Delta PM$" to --$C_1 \cdot \Delta PM$--.

Column 9, line 39, change "$C_{1p} \Delta PM$" to --$C_{1\Sigma} \Delta PM$--.

Column 11, line 57, change "$\underline{\underline{\sim}}$" to --$\underline{\underline{\leq}}$--.

Column 12, line 31, change "valve" to --value--.

Column 13, line 5, change "$t$," to --$L'$--.

UNITED STATES PATENT AND TRADEMARK OFFICE

CERTIFICATE OF CORRECTION

PATENT NO. : 5,018,494

DATED : May 28, 1991

INVENTOR(S) : Yukihiro SONODA, et al.

It is certified that error appears in the above-identified patent and that said Letters Patent is hereby corrected as shown below:

Column 13, line 14, change "$\llcorner$" to --$\lrcorner$--.

Column 14, line 51, change "$<$" to --$>$--.

Column 15, line 29, change "valve" to --value--.

Column 15, line 37, change "=" to --$\leq$--.

Column 16, line 17, change "determine" to --determined--.

Column 18, line 40, change "$<$" to --$\leq$--.

Column 22, line 59, change "aid" to --said-- and insert --of-- between "change" and "the".

Signed and Sealed this

Seventeenth Day of March, 1992

*Attest:*

*Attesting Officer*

HARRY F. MANBECK, JR.

*Commissioner of Patents and Trademarks*